US008166878B2

(12) United States Patent
Saito

(10) Patent No.: US 8,166,878 B2
(45) Date of Patent: May 1, 2012

(54) LIQUID TRANSFER APPARATUS

(75) Inventor: Hirofumi Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 291 days.

(21) Appl. No.: 12/521,294

(22) PCT Filed: Aug. 8, 2008

(86) PCT No.: PCT/JP2008/064295
§ 371 (c)(1),
(2), (4) Date: Jun. 25, 2009

(87) PCT Pub. No.: WO2009/022645
PCT Pub. Date: Feb. 19, 2009

(65) Prior Publication Data

US 2010/0132573 A1 Jun. 3, 2010

(30) Foreign Application Priority Data

Aug. 10, 2007 (JP) ..... 2007-209181

(51) Int. Cl.
*B41F 22/00* (2006.01)

(52) U.S. Cl. ..... 101/424.1; 101/416.1

(58) Field of Classification Search ..... 101/424.1
See application file for complete search history.

(56) References Cited

U.S. PATENT DOCUMENTS 6,324,376 B1 * 11/2001 Koguchi ..... 399/335
6,912,957 B2 * 7/2005 Aoyama et al. ..... 101/487
7,439,995 B2 * 10/2008 Ali et al. ..... 347/217
7,726,240 B2 * 6/2010 Saito et al. ..... 101/424
2007/0012209 A1 1/2007 Ichimura

FOREIGN PATENT DOCUMENTS

EP 1 777 076 A1 4/2007
EP 1 918 098 A2 5/2008
JP 2003-237018 A 8/2003
JP 2006-231593 A 9/2006
JP 2006-297690 A 11/2006
JP 2007-001314 A 1/2007

* cited by examiner

*Primary Examiner* — Anthony Nguyen
(74) *Attorney, Agent, or Firm* — Blakely, Sokoloff, Taylor & Zafman

(57) ABSTRACT

An ultraviolet drying device (37) and a photoelectric sensor (70) for detecting the outer surface of a transport cylinder (36) are provided at a position close to the outer surface of the transport cylinder (36) arranged downstream in a sheet-like material convey direction of a reverse printing unit (11) for subsequent printing. When the ultraviolet drying device (37) is turned on and the photoelectric sensor (70) detects that a contamination-preventive member is mounted on the outer surface of the transport cylinder (36), the driving of a printing press stops. Also, when an IR lamp (46) of an infrared drying device (47) is turned on and the photoelectric sensor (70) detects that the contamination-preventive member is not mounted on the outer surface of the transport cylinder (36), the driving of the printing press is stopped. With this arrangement, deformation of the contamination-preventive member mounted to protect the cylinder is prevented in a liquid transfer apparatus.

23 Claims, 13 Drawing Sheets

LIQUID TRANSFER APPARATUS

This is a non-provisional application claiming the benefit of International application number PCT/JP2008/064295 filed Aug. 8, 2008.

TECHNICAL FIELD

The present invention relates to a liquid transfer apparatus in a printing press, coating apparatus, or the like, which transfers a liquid such as ink, varnish, or the like to a liquid transfer target body such as a sheet, web, or the like.

BACKGROUND ART

In a liquid transfer apparatus of this type, to improve the quality of printing or coating, immediately after ink or varnish is transferred to a sheet or web, the transferred ink or varnish is dried. U.S. Pre-Grant Publication No. 2007/0012209 proposes a printing press comprising a blanket cylinder which is in contact with a plate cylinder and receives ink corresponding to a given pattern from the plate cylinder, an impression cylinder arranged to oppose the blanket cylinder, and an ultraviolet drier called an interdeck which irradiates with ultraviolet rays the outer surfaces of the impression cylinder and blanket cylinder downstream of the contact point of the impression cylinder and blanket cylinder in the sheet convey direction. In such a printing press, when the sheet which is conveyed as it is held by the gripper of the impression cylinder passes between the impression cylinder and blanket cylinder, the pattern is transferred to the sheet from the blanket cylinder. Immediately after that, the ultraviolet drier dries the pattern.

DISCLOSURE OF INVENTION

Problem to be Solved by the Invention

In the conventional printing press described above, a contamination-preventive member formed of an aluminum plate is mounted on the outer surface of the impression cylinder to protect it from contamination or scratches. If the contamination-preventive member being mounted is irradiated with the ultraviolet rays, heat of the ultraviolet rays may deform the contamination-preventive member.

It is an object of the present invention to provide a liquid transfer apparatus in which deformation of a contamination-preventive member mounted for protecting a cylinder is prevented.

Means of Solution to the Problem

In order to achieve the above object, a liquid transfer apparatus according to the present invention comprises a transport cylinder which conveys a liquid transfer target body to which a liquid has been transferred, a drying device which is arranged to oppose an outer surface of the transport cylinder and dries the liquid transferred to the liquid transfer target body on the transport cylinder, a contamination-preventive member selectively mounted on the outer surface of the transport cylinder, sensor means for detecting mounting/non-mounting of the contamination-preventive member on the outer surface of the transport cylinder, and a control device which controls the drying device in an inoperative state when the sensor means detects that the contamination-preventive member is mounted.

Effect of the Invention

According to the present invention, even if the operator forgets to remove the contamination-preventive member from the transport cylinder, the contamination-preventive member can be prevented from being deformed by the heat of the drying device. In addition, even if the operator forgets to mount the contamination-preventive member on the transport cylinder, the outer surface of the transport cylinder can be prevented from being contaminated.

BEST MODE FOR CARRYING OUT THE INVENTION

A liquid transfer apparatus according to the first embodiment of the present invention will be described hereinafter with reference to FIGS. 1A to 7D.

Figure 1A:
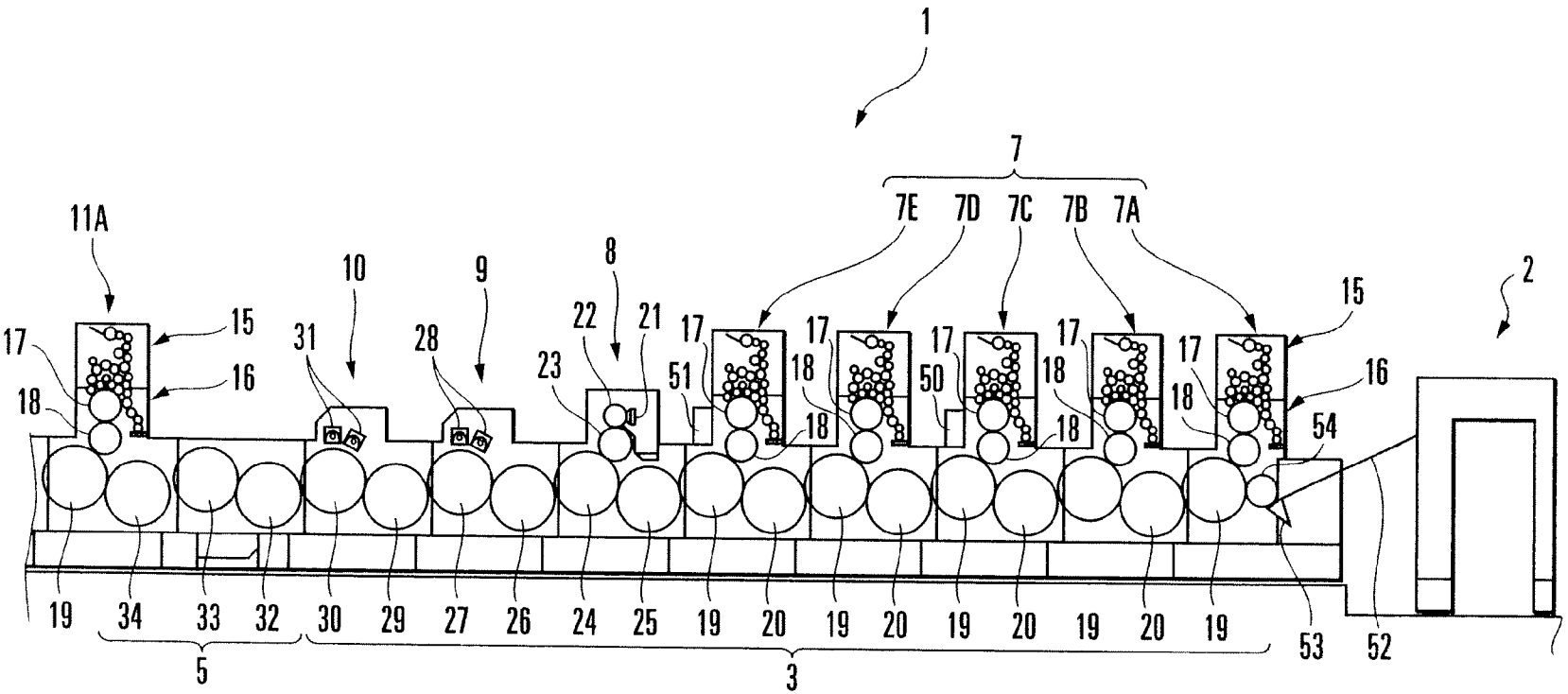
FIGS. 1A and 1B are views respectively showing the layouts of upstream and downstream liquid transfer devices of a double-sided sheet-fed rotary printing press according to the first embodiment of the present invention.
Figure 1B:
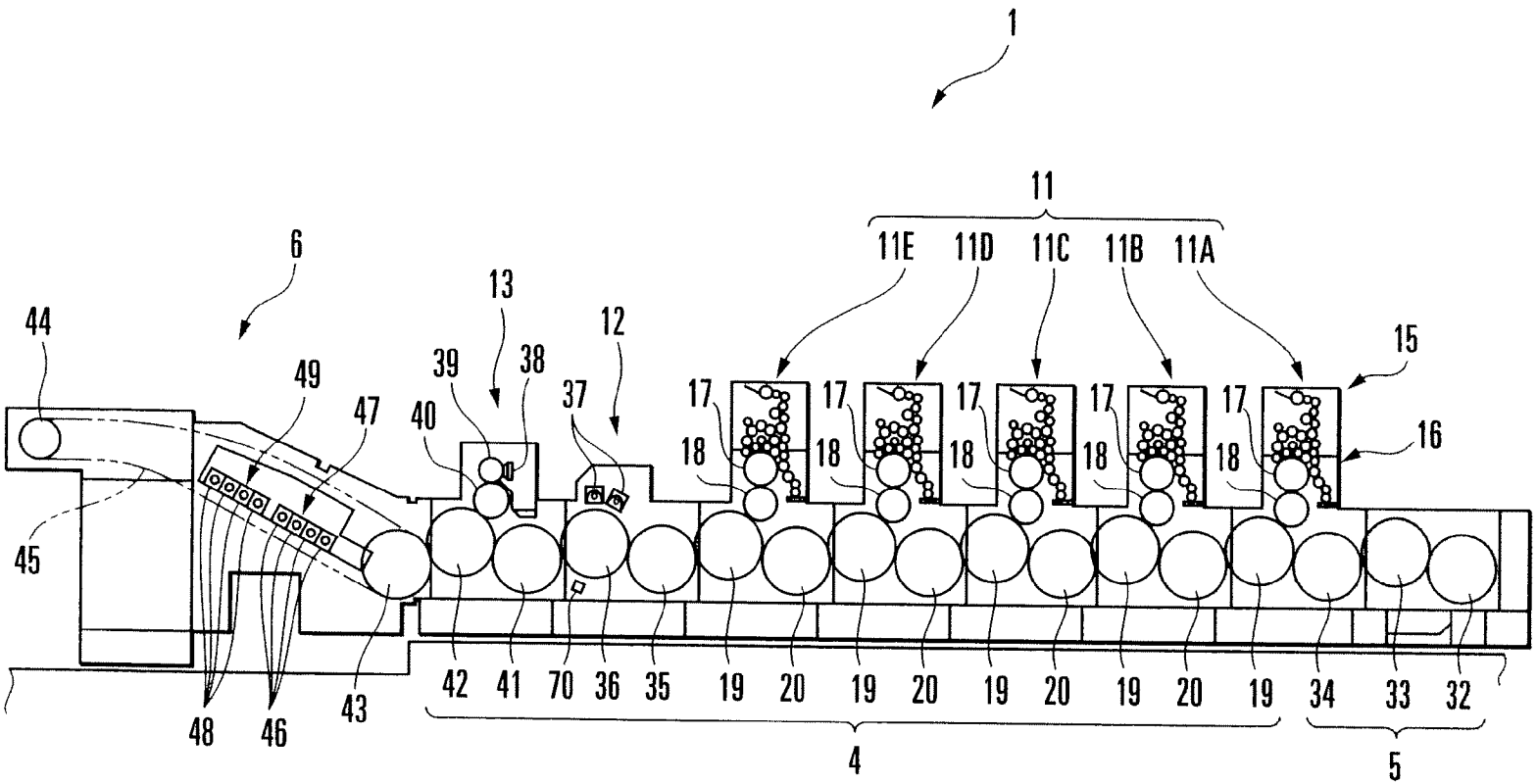

As shown in FIGS. 1A and 1B, a double-sided sheet-fed rotary printing press 1 includes a feed device 2 which feeds sheets as liquid transfer target bodies one by one, an upstream liquid transfer device 3 which prints and coats with varnish the obverse of a sheet fed from the feed device 2, a downstream liquid transfer device 4 which prints and coats with varnish the obverse or reverse of the sheet, a convertible device 5 which is arranged between the liquid transfer devices 3 and 4 and selectively turns over the sheet, and a delivery device 6 which delivers the sheet transferred from the liquid transfer device 4.

In the liquid transfer device 3, a first printing unit 7 including five sets of printing units 7A to 7E, a first varnish coating unit 8, an infrared drying device 9 for the upstream liquid transfer device which dries oil-based ink and water varnish, and an ultraviolet drying device 10 for the upstream liquid transfer device which dries ultraviolet ink (to be referred to as UV ink hereinafter) and ultraviolet varnish (to be referred to as UV varnish hereinafter) are sequentially arranged from upstream to downstream in the sheet convey direction.

In the liquid transfer device 4, a second printing unit 11 including five sets of printing units 11A to 11E, an ultraviolet drying device 12 for the downstream liquid transfer device which dries the UV ink and UV varnish, and a second varnish coating unit 13 are sequentially arranged from upstream to downstream in the sheet convey direction.

Each of the printing units 7A to 7E and 11A to 11E includes a plate cylinder 17 provided with an inking device 15 and dampening device 16, a blanket cylinder 18 arranged to oppose the plate cylinder 17, and an impression cylinder 19 arranged to oppose the blanket cylinder 18. A transfer cylinder 20 is arranged between the impression cylinders 19 of every other ones of the printing units 7A to 7E and 11A to 11E.

The first varnish coating unit 8 includes an anilox roller 22 to which a chamber coater 21 supplies the varnish, a blanket cylinder 23 which is arranged to oppose the anilox roller 22 and to which the anilox roller 22 transfers the varnish, and an impression cylinder 24 which is arranged to oppose the blanket cylinder 23 and which conveys the sheet transferred from a transfer cylinder 25.

The infrared drying device 9 includes a transfer cylinder 26 to which the impression cylinder 24 of the first varnish coating unit 8 transfers the sheet, a transport cylinder 27 to which the transfer cylinder 26 transfers the sheet, and infrared lamps (to be referred to as IR lamps hereinafter) 28 arranged at positions close to the outer surface of the transport cylinder 27.

The ultraviolet drying device 10 includes a transfer cylinder 29 to which the transport cylinder 27 of the infrared drying device 9 transfers the sheet, a transport cylinder 30 to which the transfer cylinder 29 transfers the sheet, and ultraviolet lamps (to be referred to as UV lamps hereinafter) 31 arranged at positions close to the outer surface of the transport cylinder 30.

The convertible device 5 includes three cylinders, i.e., a transfer cylinder 32, chuck cylinder 33, and convertible cylinder 34. When the sheet is transferred by the transfer cylinder 32 and chuck cylinder 33, the convertible cylinder 34 selects whether or not to turn over the sheet, and the sheet is transferred to the impression cylinder 19 of the printing unit 11A.

The ultraviolet drying device 12 includes a transfer cylinder 35 to which the impression cylinder 19 of the printing unit 11E transfers the sheet, a transport cylinder 36 to which the transfer cylinder 35 transfers the sheet, and UV lamps 37 arranged at positions close to the outer surface of the transport cylinder 36.

The second varnish coating unit 13 includes an anilox roller 39 to which a chamber coater 38 supplies the varnish, a blanket cylinder 40 which is arranged to oppose the anilox roller 39 and to which the anilox roller 39 transfers the varnish, and an impression cylinder 42 which is arranged to oppose the blanket cylinder 40 and which conveys the sheet transferred from a transfer cylinder 41.

The delivery device 6 includes a sprocket 43 provided coaxially with a delivery cylinder (not shown) which opposes the impression cylinder 42 of the second varnish coating unit 13, a sprocket 44 provided at the rear portion of the delivery device 6, and a delivery chain 45 looped between the sprockets 43 and 44. An infrared drying device 47 including IR lamps 46 and an ultraviolet drying device 49 including UV lamps 48 are arranged close to the convey path of the delivery chain 45.

As shown in FIG. 1A, an ultraviolet drying device 50 is arranged close to the outer surface of the impression cylinder 19 of the printing unit 7C, and an ultraviolet drying device 51 is arranged close to the outer surface of the impression cylinder 19 of the printing unit 7E. A feeder board 52 conveys the sheets fed from the feed device 2 one by one to the first printing unit 7. A swing arm shaft pregripper 53 grips the leading edge of the sheet conveyed on the feeder board 52 and registered at the leading edge and in the widthwise direction, and transfers the sheet to a transfer cylinder 54.

Structures to mount contamination-preventive members to the cylinders will be described with reference to FIGS. 2 and 3. Contamination-preventive members 55 are detachably mounted on the transfer cylinders 20, 25, 26, and 29 of the upstream liquid transfer device 3, the transfer cylinder 32 of the convertible device 5, and the impression cylinders 19, transfer cylinders 20, 35, and 41, transport cylinder 36, and impression cylinder 42 of the downstream liquid transfer device 4. As the structures to mount the contamination-preventive members 55 to the transfer cylinders 20, 25, 26, and 29 of the upstream liquid transfer device 3, the transfer cylinder 32 of the convertible device 5, and the impression cylinders 19, transfer cylinders 20, 35, and 41, transport cylinder 36, and impression cylinder 42 of the downstream liquid transfer device 4 are all the same, that for the transport cylinder 36 will be described hereinafter, and those for the other cylinders will be described where necessary.

Figure 2:
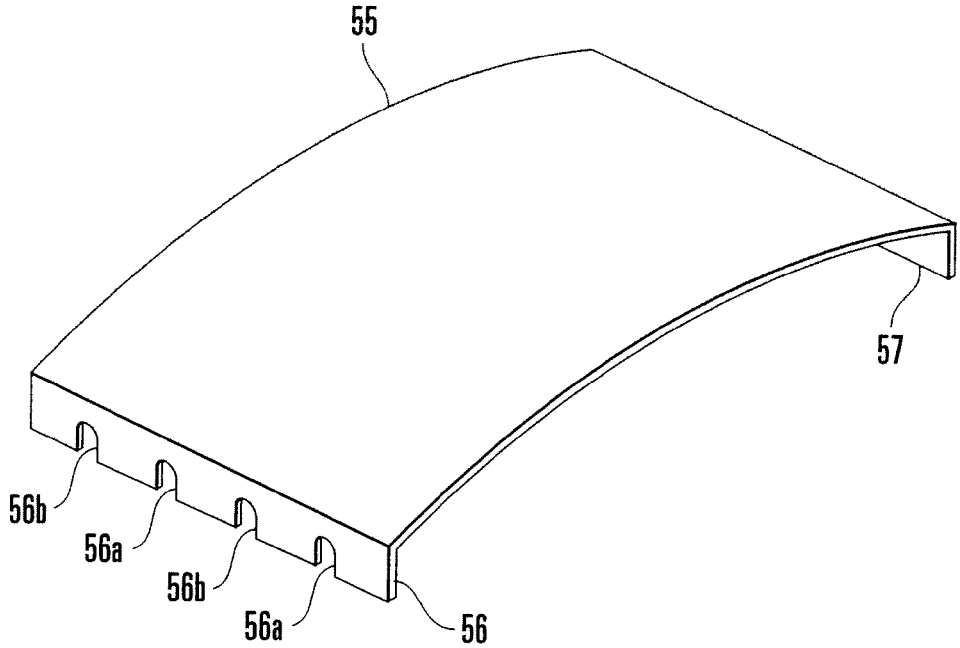
FIG. 2 is a perspective view of a contamination-preventive member to be mounted on the outer surface of each of the cylinders shown in FIGS. 1A and 1B.

As shown in FIG. 2, each contamination-preventive member 55 is formed of a metal thin plate which is flexible entirely, and its two ends are bent at almost right angles to form insertion ends 56 and 57. The insertion end 56 has a plurality of wide U-shaped grooves 56*a* and a plurality of narrow U-shaped grooves 56*b* alternately.

Figure 3:
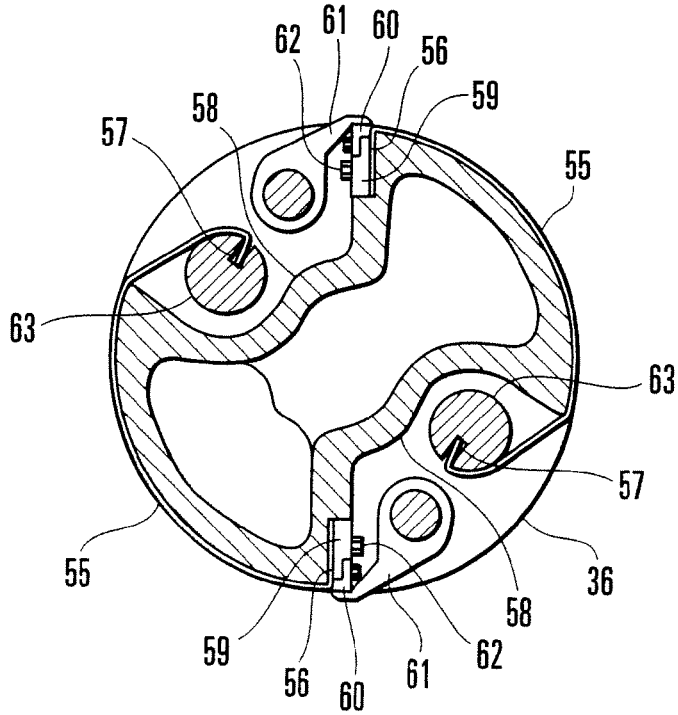
FIG. 3 is a sectional view of a transport cylinder on which the contamination-preventive members shown in FIG. 2 are mounted.

As shown in FIG. 3, a pair of notches 58 are formed in the outer surface of the transport cylinder 36, at positions phase-shifted from each other by 180° in the circumferential direction, to extend throughout the entire length of the transport cylinder 36. A gripper pad 60 fixed to a gripper pad bar 59, and a gripper 61 which opens/closes with respect to the gripper pad 60 are arranged in each notch 58. In this arrangement, the insertion end 56 of the contamination-preventive member 55 is inserted between the gripper pad bar 59 and the wall surface of the notch 58, and the U-shaped grooves 56*b* are engaged with positioning pins (not shown) provided in the notch 58. Then, bolts 62 are fastened to fix the insertion end 56 to the wall surface of one notch 58.

In this state, the contamination-preventive member 55 is wound around the outer surface of the transport cylinder 36, and the insertion end 57 is engaged in a notch in a winding rod 63 provided in the other notch 58. Then, the winding rod 63 is pivoted while regulating its reverse rotation by a ratchet mechanism (not shown), so that the contamination-preventive member 55 is mounted tightly on the outer surface of the transport cylinder 36.

When removing the contamination-preventive member 55, the winding rod 63 is rotated in the reverse direction to loosen the contamination-preventive member 55, and the bolts 62 are loosened. After that, the contamination-preventive member 55 is pulled out from the gap between the gripper pad bar 59 and the wall surface of the notch 58.

Figure 4:
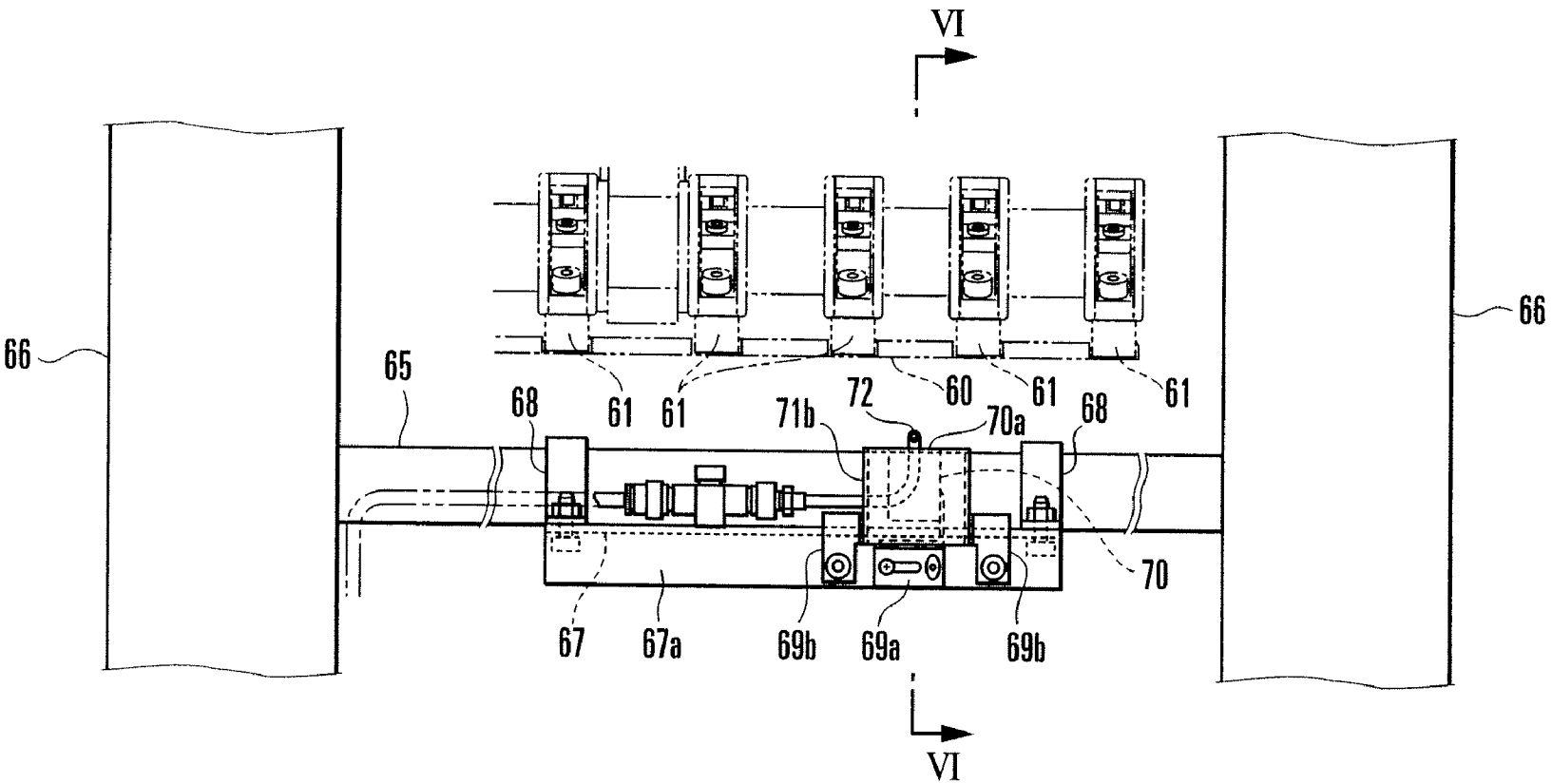
FIG. 4 is a front view of the main part of the double-sided sheet-fed rotary printing press shown in FIGS. 1A and 1B.
Figure 5:
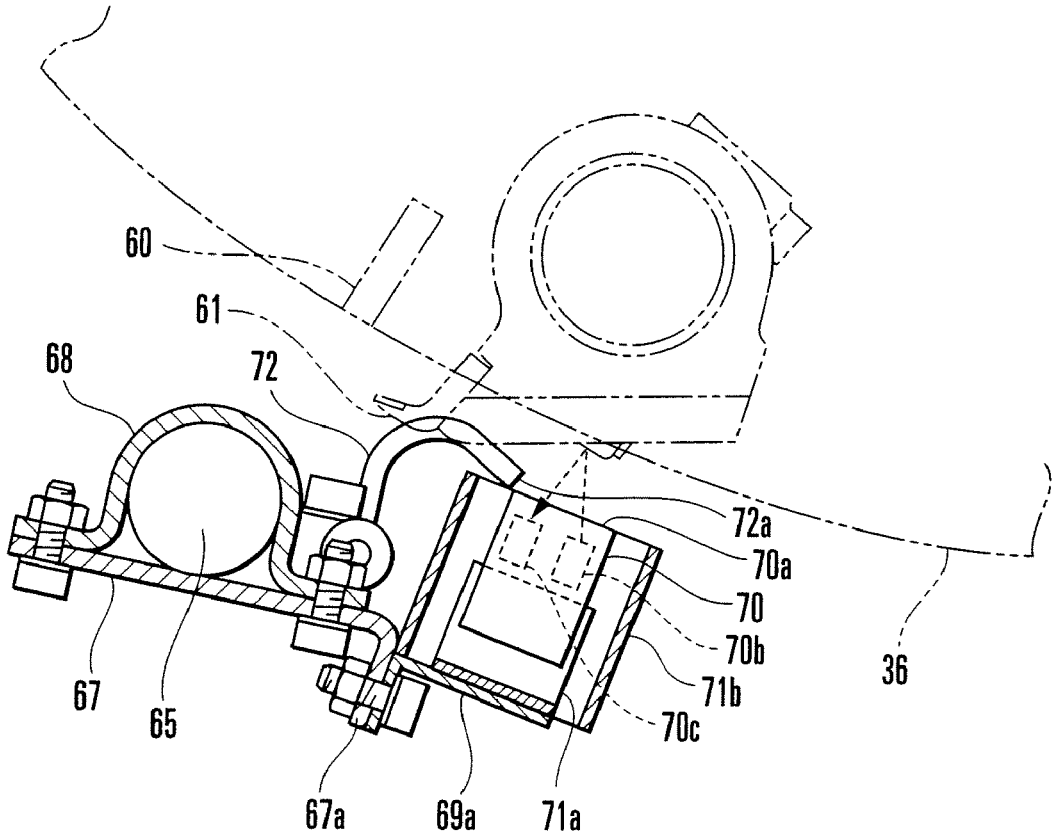
FIG. 5 is a sectional view taken along the line VI-VI of FIG. 4.

A photoelectric sensor which detects whether or not the contamination-preventive member 55 is mounted on the transport cylinder 36 will be described with reference to FIGS. 4 and 5. As shown in FIG. 4, a bracket 67 having an inverted-L-shaped section is attached to a support rod 65, horizontally extending between a pair of frames 66, through attaching metal fixtures 68 each having an inverted-U-shaped section, as shown in FIG. 5.

A photoelectric sensor 70 is attached to a first support member 69*a*, attached to a bend portion 67*a* of the bracket 67 and having an L-shaped section, through a holder 71*a* having an L-shaped section. A square cylindrical cover 71*b* which surrounds the photoelectric sensor 70 is attached to the bend portion 67*a* of the bracket 67 through a pair of second support members 69*b*. The photoelectric sensor 70 includes a light-emitting device 70*b* and a light-receiving device 70*c*. The photoelectric sensor 70 is arranged such that a detection surface 70*a* opposes the outer surface of the transport cylinder 36, and detects the gloss of the surface of a detection target body from the quantity of the light which enters the light-receiving device 70*c* after being radiated from the light-emitting device 70*b* and reflected by the surface of the detection target body. The photoelectric sensor 70 is arranged to oppose the UV lamps 37 through the transport cylinder 36, as shown in FIG. 1B. With this arrangement, the transport cylinder 36 blocks the light emitted from the UV lamps 37 and the heat generated from them during drying operation, and therefore the photoelectric sensor 70 itself will not be damaged.

The photoelectric sensor 70 is arranged upstream, in the rotation direction of the transport cylinder 36, of the transfer position at which the upstream transfer cylinder 35 for transferring the sheet to the transport cylinder 36 transfers the sheet to the transport cylinder 36, and downstream, in the rotation direction of the transport cylinder 36, of the reception position at which the downstream transfer cylinder 41 receives the sheet from the transport cylinder 36, and opposes the transport cylinder 36. Since the photoelectric sensor 70 is not arranged in the convey path of the sheet which is conveyed by the transport cylinder 36, the photoelectric sensor 70 can reliably detect the presence/absence of the contamination-preventive member 55 mounted on the transport cylinder 36. An air nozzle 72 (cleaning means) attached to the bracket 67 is provided close to the photoelectric sensor 70. A discharge port 72*a* of the air nozzle 72 is directed toward the detection surface 70*a* of the photoelectric sensor 70 to spray air supplied from an air supply source (not shown) onto the detection surface 70*a* of the photoelectric sensor 70.

The photoelectric sensor 70 detects the gloss of the outer surface of the transport cylinder 36 or that of the contamination-preventive member 55 mounted on the outer surface of the transport cylinder 36. A controller 85 (FIG. 6) determines mounting/non-mounting of the contamination-preventive member 55 based on the gloss detected by the photoelectric sensor 70. That is, a determination unit 85*a* of the controller 85 determines that the contamination-preventive member 55 is not mounted when the detected gloss is higher than the reference gloss, and determines that the contamination-preventive member 55 is mounted when the detected gloss is lower than the reference gloss. More specifically, the photoelectric sensor 70 detects the light (light quantity) reflected by the outer surface of the transport cylinder 36 or the contamination-preventive member 55, and the determination unit 85*a* of the controller 85 determines mounting/non-mounting of the contamination-preventive member 55 based on the reflected light (light quantity) detected by the photoelectric sensor 70. In this case, the determination unit 85*a* of the controller 85 compares the reflected light (light quantity) detected by the photoelectric sensor 70 with the reference reflected light (light quantity), determines that the contamination-preventive member 55 is not mounted when the detected reflected light is larger than the reference reflected light, and determines that the contamination-preventive member 55 is mounted when the detected reflected light is smaller than the reference reflected light.

Figure 6:
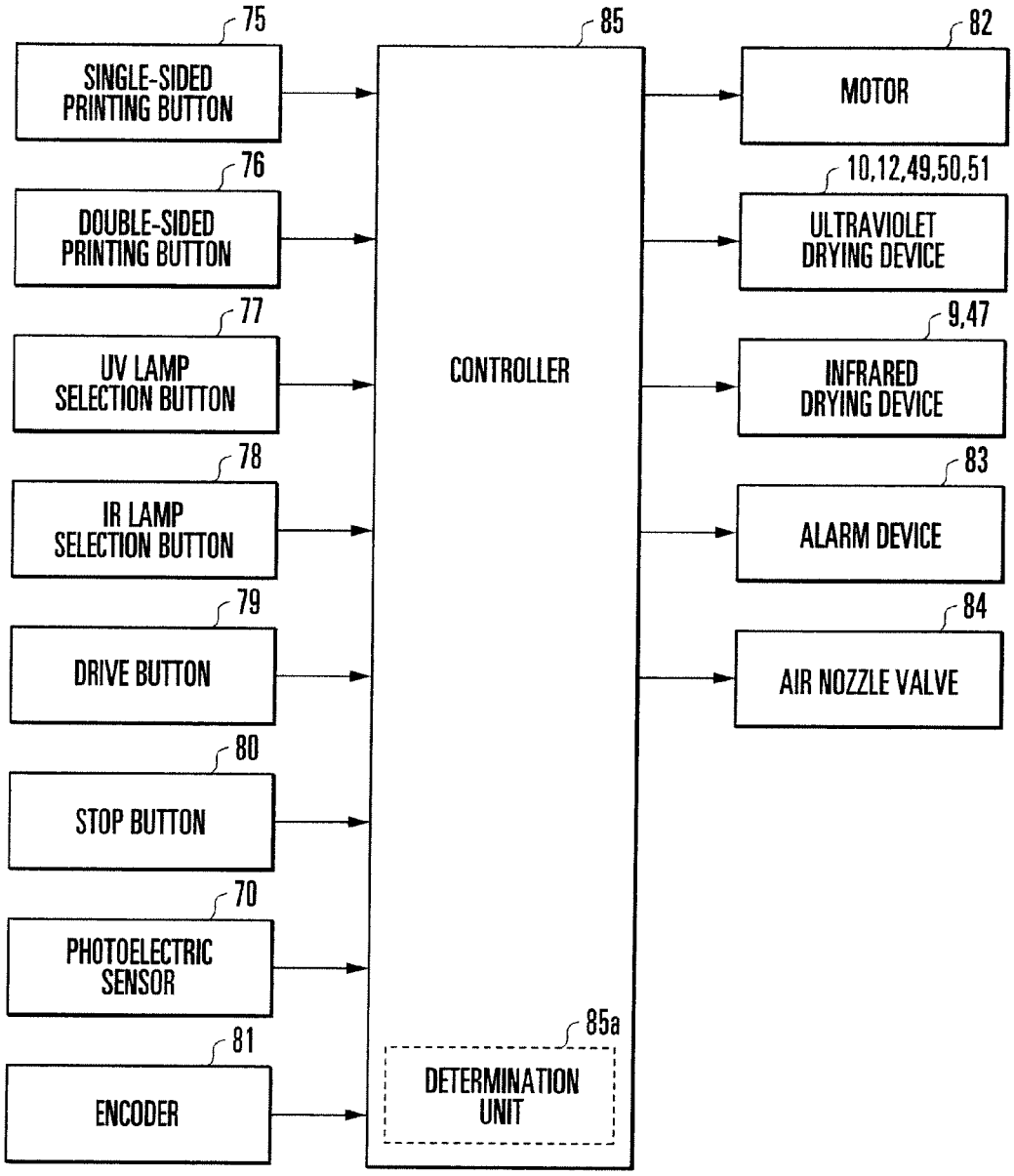
FIG. 6 is a block diagram showing the electrical configuration of the double-sided sheet-fed rotary printing press shown in FIGS. 1A and 1B.
Figure 7A:
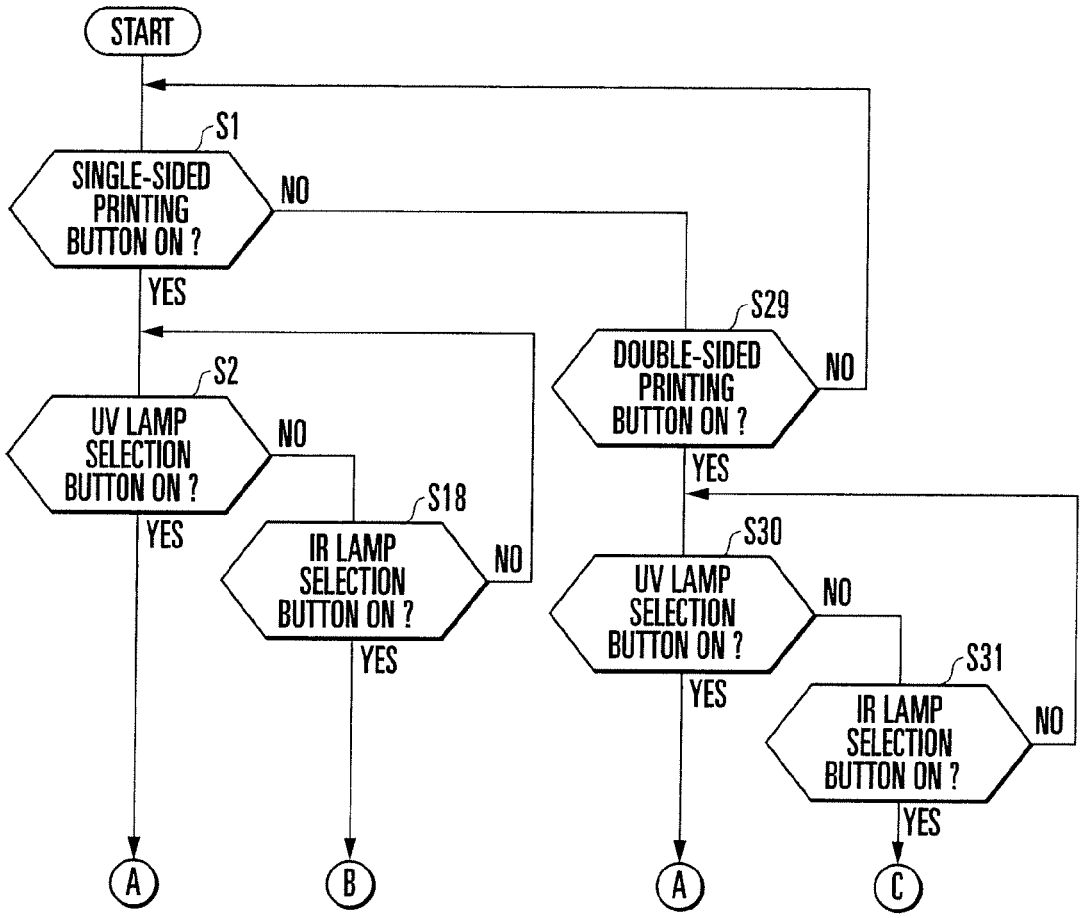
FIGS. 7A to 7D are flowcharts for explaining the drying operations by selectively combining single-sided printing and double-sided printing and UV and IR lamps in the first embodiment.
Figure 7B:
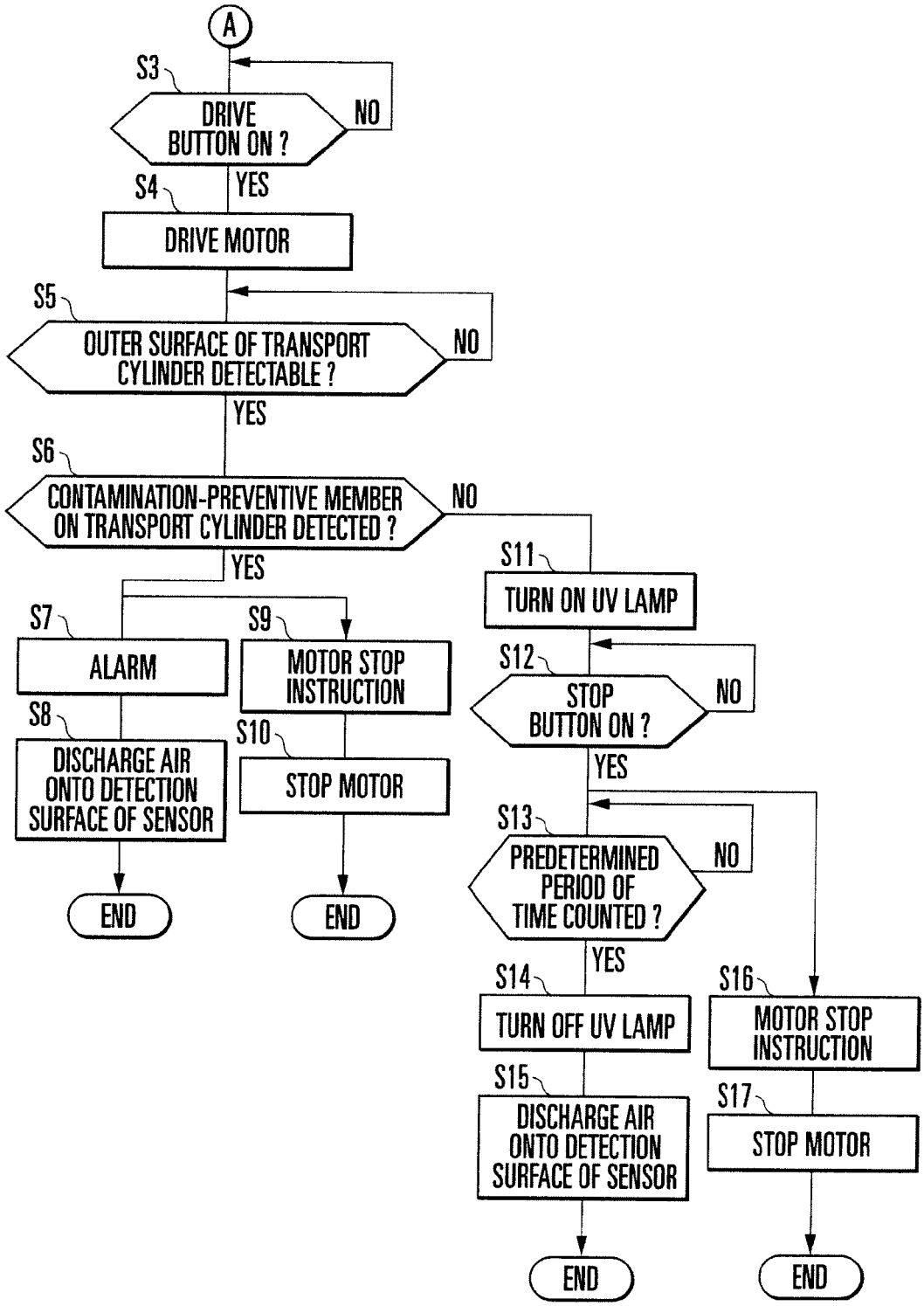
Figure 7C:
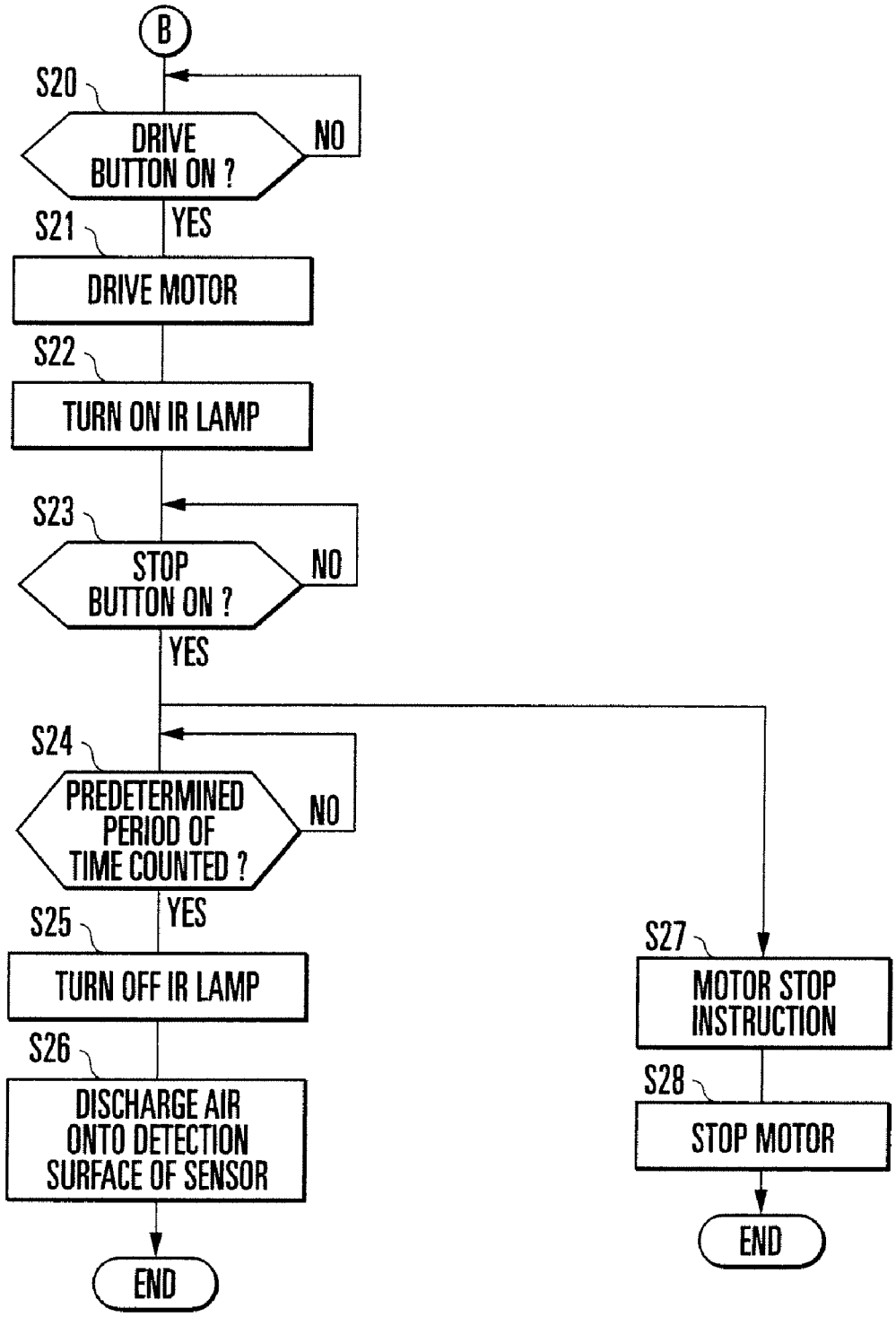
Figure 7D:
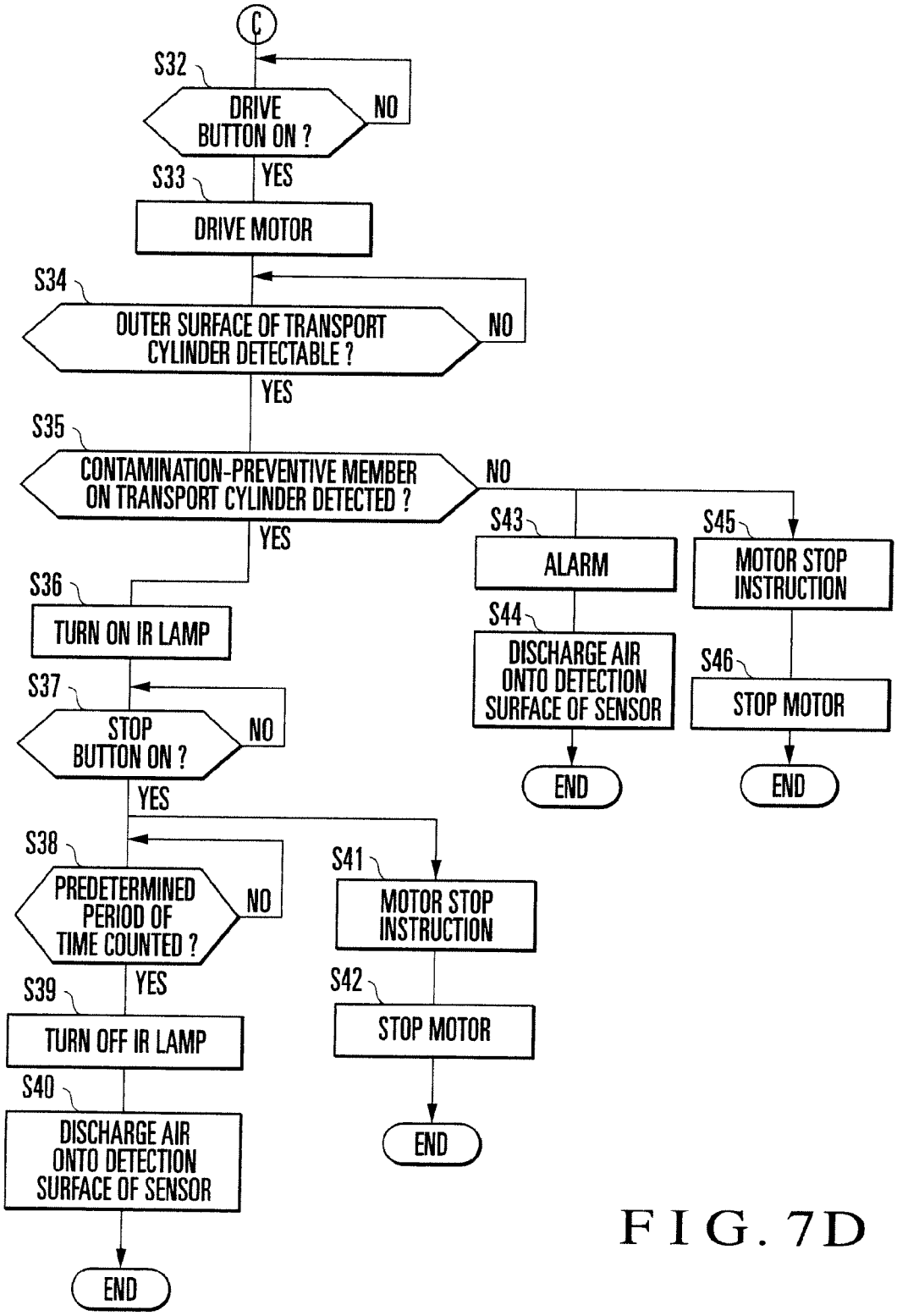
Figure 8A:
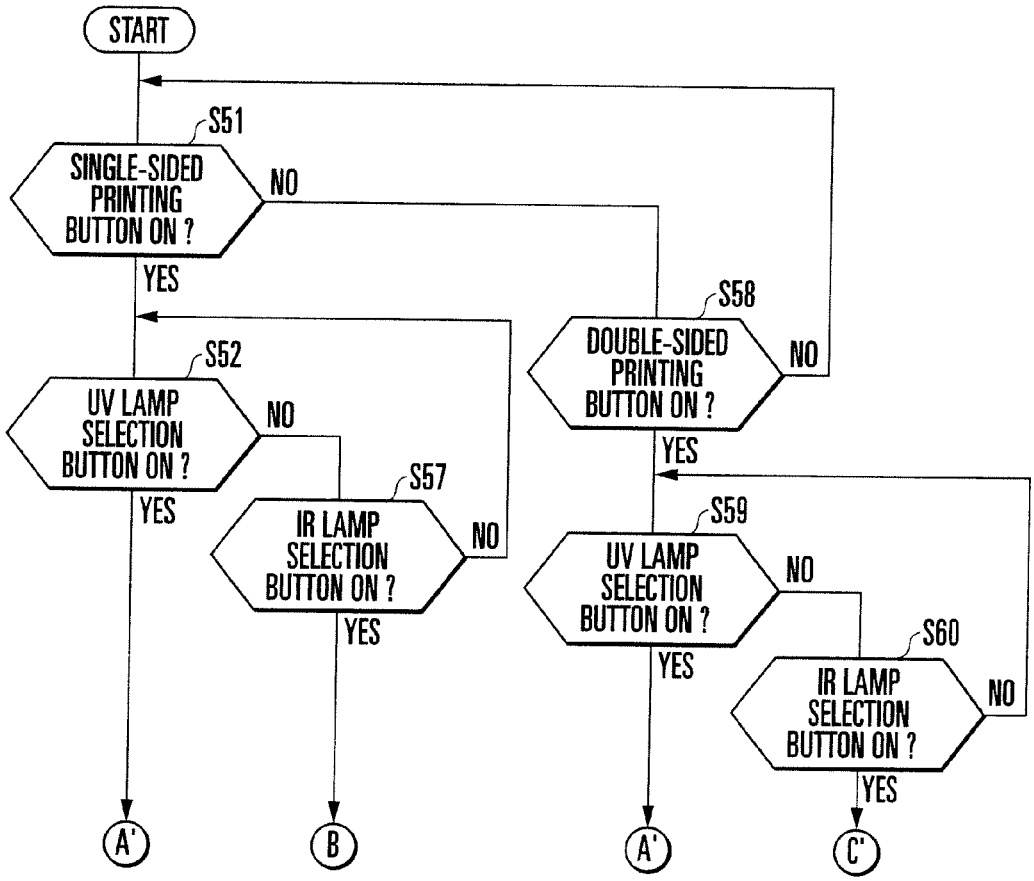
FIGS. 8A to 8C are flowcharts for explaining the drying operations by selectively combining single-sided printing and double-sided printing and UV and IR lamps in the second embodiment of the present invention.
Figure 8B:
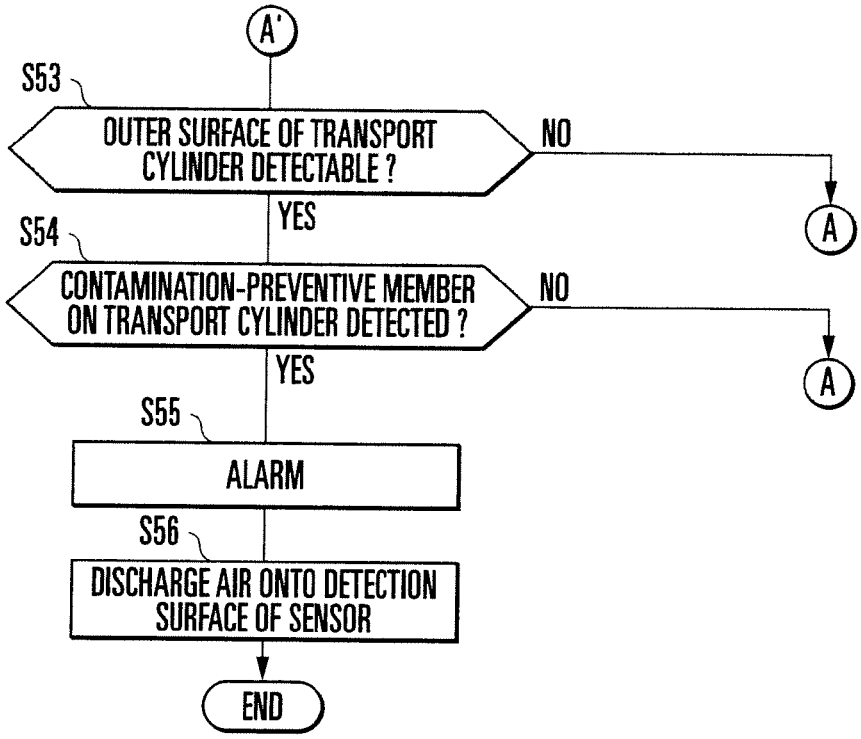
Figure 8C:
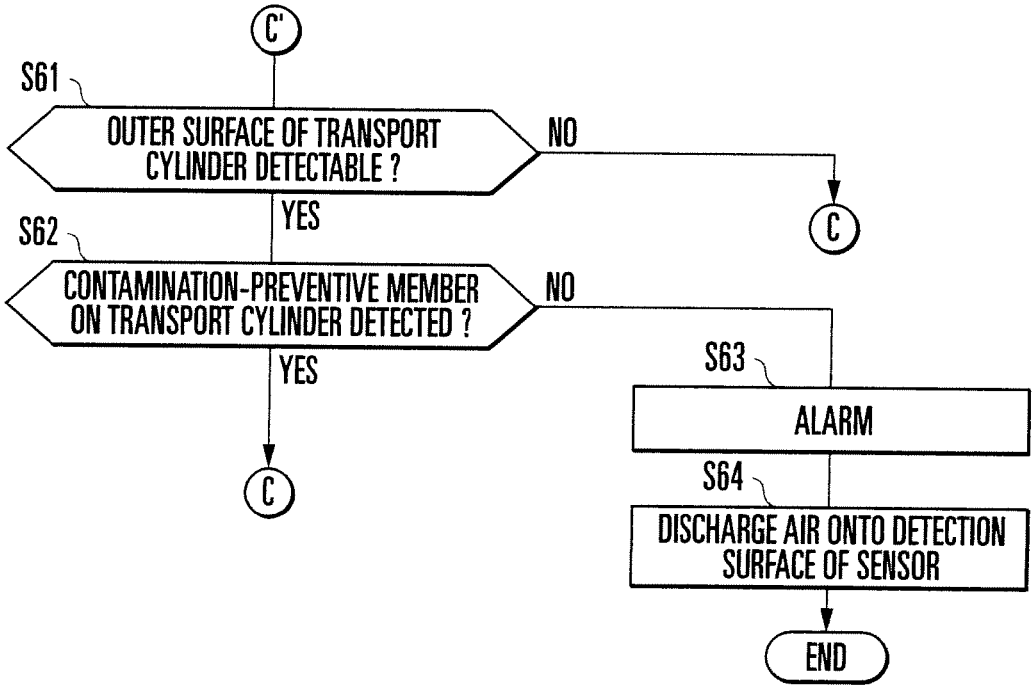

As shown in FIG. 6, the controller 85 is connected to, in addition to the ultraviolet drying devices 10, 12, and 49 to 51 and infrared drying devices 9 and 47 described above, a single-sided printing button 75 as a single-sided printing switch, double-sided printing button 76 as a double-sided printing switch, UV lamp selection button, IR lamp selection button 78 as an infrared drying device selection switch, drive button 79, stop button 80, and encoder 81 (rotational angle detection means). The single-sided printing button 75 selects single-sided printing. The double-sided printing button 76 selects double-sided printing. The UV lamp selection button turns on/off the respective UV lamps of the ultraviolet drying devices 10, 12 and 49 to 51 separately. The IR lamp selection button 78 turns on/off the respective IR lamps of the infrared drying devices 9 and 47 separately. The drive button 79 designates the printing press to drive. The stop button 80 designates the printing press to stop driving. The encoder 81 detects the rotational angle of the printing press, i.e., the notches 58 of the transport cylinder 36.

The controller 85 is also connected to a motor 82 which drives the printing press, an alarm device 83, and an air nozzle valve 84 provided between the air nozzle 72 and the air supply source. When the air nozzle valve 84 is opened, air is sprayed from the discharge port 72*a* onto the detection surface 70*a* of the photoelectric sensor 70. The controller 85 performs the following control operation in accordance with the operations of the buttons 75 to 78.

When the operator turns on the single-sided printing button 75 and a UV lamp selection button 77 (when the UV ink and/or UV varnish is to be used), the controller 85 detects mounting/non-mounting of the contamination-preventive member 55. When the photoelectric sensor 70 detects the gloss of the outer surface of the transport cylinder 36 or that of the contamination-preventive member 55 mounted thereon, the controller 85 determines mounting/non-mounting of the contamination-preventive member 55 based on this detection by the photoelectric sensor 70. That is, when the detected gloss is higher than the reference gloss, the controller 85 determines that the contamination-preventive member 55 is not mounted, and determines that the contamination-preventive member 55 is mounted when the detected gloss is lower than the reference gloss. When the controller 85 detects mounting of the contamination-preventive member 55, it stops driving the motor 82, actuates the alarm device 83, and opens the air nozzle valve 84 for a predetermined period of time.

When the operator turns on the single-sided printing button 75 and IR lamp selection button 78 (when the oil-based ink and/or water varnish is to be used), the controller 85 stops the operation of the photoelectric sensor 70 of detecting mounting/non-mounting of the contamination-preventive member 55. Simultaneously, the controller 85 turns off the IR lamps 28 and 46, and opens the air nozzle valve 84 for a predetermined period of time.

When the operator turns on the double-sided printing button 76 and UV lamp selection button 77 (when the UV ink and/or UV varnish is to be used), the controller 85 detects mounting/non-mounting of the contamination-preventive member 55. When the photoelectric sensor 70 detects the gloss of the outer surface of the transport cylinder 36 or that of the contamination-preventive member 55 mounted thereon, the controller 85 determines mounting/non-mounting of the contamination-preventive member 55 based on this detection by the photoelectric sensor 70. That is, the controller 85 determines that the contamination-preventive member 55 is not mounted when the detected gloss is higher than the reference gloss, and determines that the contamination-preventive member 55 is mounted when the detected gloss is lower than the reference gloss. When the controller 85 detects mounting of the contamination-preventive member 55, it stops driving the motor 82, actuates the alarm device 83, and opens the air nozzle valve 84 for a predetermined period of time.

When the operator turns on the double-sided printing button 76 and IR lamp selection button 78 (when the oil-based ink and/or water varnish is to be used), the controller 85 detects mounting/non-mounting of the contamination-preventive member 55. When the photoelectric sensor 70 detects the gloss of the outer surface of the transport cylinder 36 or that of the contamination-preventive member 55 mounted thereon, the controller 85 determines mounting/non-mounting of the contamination-preventive member 55 based on this detection by the photoelectric sensor 70. That is, the controller 85 determines that the contamination-preventive member 55 is not mounted when the detected gloss is higher than the reference gloss, and determines that the contamination-preventive member 55 is mounted when the detected gloss is lower than the reference gloss. When the controller 85 detects non-mounting of the contamination-preventive member 55, it stops driving the motor 82, actuates the alarm device 83, and opens the air nozzle valve 84 for a predetermined period of time.

When the controller 85 detects that either notch 58 of the transport cylinder 36 opposes the detection surface 70*a* of the photoelectric sensor 70 based on the detection by the encoder 81 of the rotational angle of the printing press, it stops the operation of the photoelectric sensor 70 of detecting mounting/non-mounting of the contamination-preventive member 55.

The drying operation of drying the ink/varnish applied to the sheet will be described with reference to FIGS. 7A to 7D. First, a case of single-sided printing with the UV ink and UV varnish will be described. In this case, the controller 85 detects that the single-sided printing button 75 is turned on by the operator (YES in step S1, FIG. 7A), and that the UV lamp selection button 77 is turned on (YES in step S2).

Then, upon detection that the operator turns on the drive button 79 (YES in step S3, FIG. 7B), the controller 85 drives the motor 82 (step S4). If the drive button 79 is not turned on in step S3, the controller 85 repeats the detection operation until detecting that the drive button 79 is turned on. When the motor 82 starts driving, the feed operation of the feed device 2 is started, and the respective blanket cylinders 18 of the printing units 7A to 7E and the blanket cylinder 23 of the varnish coating unit 8 are sequentially impression thrown-on.

When the motor 82 is driven and the printing press has reached a predetermined slower speed which is slower than the printing speed, the controller 85 checks whether or not the photoelectric sensor 70 is currently capable of detecting the outer surface of the transport cylinder 36 (step S5). More specifically, on the basis of the detection by the encoder 81 of the rotational angle of the printing press, the controller 85 checks the relationship between the notches 58 of the transport cylinder 36 and the detection surface 70*a* of the photoelectric sensor 70. If either notch 58 of the transport cylinder 36 opposes the detection surface 70*a* of the photoelectric sensor 70, the controller 85 determines that the photoelectric sensor 70 cannot detect the outer surface of the transport cylinder 36. The controller 85 repeats step S5 until detection of the outer surface of the transport cylinder 36 becomes possible.

The controller 85 advances to the next process when the photoelectric sensor 70 can detect the outer surface of the transport cylinder 36 (YES in step S5), that is, only when the region of the transport cylinder 36 other than the notches 58 opposes the detection surface 70*a* of the photoelectric sensor 70. In this manner, the notches 58 having a gloss different from that of the outer surface of the transport cylinder 36 may not be detected, so that erroneous detection of the outer surface of the transport cylinder 36 can be prevented.

When the controller 85 determines that the gloss detected by the photoelectric sensor 70 is lower than the reference gloss (YES in step S6), it determines that the contamination-preventive member 55 is mounted on the outer surface of the transport cylinder 36. Then, the controller 85 actuates the alarm device 83 (step S7). Thus, the operator is informed of an alarm indicating that the contamination-preventive member 55 is left mounted on the outer surface of the transport cylinder 36. The controller 85 then opens the air nozzle valve 84, and the air nozzle 72 sprays air from the discharge port 72*a* onto the detection surface 70*a* of the photoelectric sensor 70 for a predetermined period of time (step S8).

Also, upon determination that the gloss detected by the photoelectric sensor 70 is lower than the reference gloss (step S6), the controller 85 outputs a stop instruction to the motor 82 (step S9). Thus, the motor 82 stops driving (step S10).

In this manner, if the contamination-preventive member 55 is left mounted on the outer surface of the transport cylinder 36, the printing press stops driving before the UV lamps 37 are turned on. Therefore, when the UV lamps 37 are turned on, heat generated by the UV lamps 37 will not deform the contamination-preventive member 55. Since the operator is informed of the alarm indicating that the contamination-preventive member 55 is left mounted on the outer surface of the transport cylinder 36, the down time of the printing press is minimized to prevent a decrease in productivity.

Every time the printing press stops driving, air is sprayed onto the detection surface 70*a* of the photoelectric sensor 70, so the detection surface 70*a* can always be kept clean. Thus, erroneous detection by the photoelectric sensor 70 can be prevented.

When the controller 85 determines that the gloss detected by the photoelectric sensor 70 is higher than the reference gloss (NO in step S6), it determines that the contamination-preventive member 55 is not mounted on the outer surface of the transport cylinder 36. The controller 85 then turns on the UV lamps 31, 37, and 48, and the UV lamps of the ultraviolet drying devices 50 and 51 before the first sheet fed from the feed device 2 is conveyed to the printing unit 7C (step S11).

In this state, the sheet fed from the feed device 2 onto the feeder board 52 is conveyed on the feeder board 52 by a belt (not shown). Then, the sheet is registered at its leading edge and in the widthwise direction, gripped by the gripper of the swing arm shaft pregripper 53, and gripping-changed to the gripper of the transfer cylinder 54. The sheet that has been gripping-changed to the gripper of the transfer cylinder 54 is gripping-changed to the gripper of the impression cylinder 19 of the printing unit 7A and conveyed. When the sheet passes between the impression cylinder 19 and blanket cylinder 18, its obverse is printed with the UV ink in the first color.

After that, when the sheet passes between the respective impression cylinders 19 and blanket cylinders 18 of the printing units 7B to 7E, its obverse is sequentially printed with the UV inks in four colors. When the sheet is conveyed by the impression cylinder 19 of the third-color printing unit 7C, the UV lamp of the ultraviolet drying device 50 dries the UV inks applied to the obverse of the sheet. When the sheet is conveyed by the impression cylinder 19 of the fifth-color printing unit 7E, the UV lamp of the ultraviolet drying device 51 dries the UV inks applied to the obverse of the sheet.

The sheet that has been transferred from the impression cylinder 19 of the printing unit 7E to the transfer cylinder 25 of the varnish coating unit 8 is gripping-changed by the gripper of the transfer cylinder 24. When the sheet passes between the transfer cylinder 24 and blanket cylinder 23, its obverse is coated with the UV varnish. The sheet with its obverse coated with the varnish is gripping-changed to the gripper of the transfer cylinder 26 of the infrared drying device 9, and to the gripper of the transport cylinder 30 through the transport cylinder 27 and the transfer cylinder 29 of the ultraviolet drying device 10.

Subsequently, when the transport cylinder 30 conveys the sheet, the UV lamps 31 dry the UV varnish. The sheet with the UV varnish dried is gripping-changed to the gripper of the transfer cylinder 32 of the convertible device 5. The sheet gripping-changed to the gripper of the transfer cylinder 32 is sequentially gripping-changed to the chuck cylinder 33 and convertible cylinder 34 of the convertible device 5. In the convertible device 5, the sheet is not turned over, and gripping-changed to the gripper of the impression cylinder 19 of the first-color printing unit 11A of the liquid transfer device 4.

Then, when the sheet passes between the respective blanket cylinders 18 and impression cylinders 19 of the printing units 11A to 11E, it is coated with the UV ink on its obverse, and gripping-changed to the gripper of the transport cylinder 36 through the transfer cylinder 35 of the ultraviolet drying device 12. When the transport cylinder 36 conveys the sheet, the UV lamps 37 dry the obverse of the sheet.

When performing single-sided printing with the UV inks and UV varnish, the printing unit 11 does not print the reverse of the sheet. Accordingly, the transport cylinder 36 is not subjected to backing printing, so the contamination-preventive member 55 need not be mounted on the transport cylinder 36. If, however, the contamination-preventive member 55 is erroneously mounted on the transport cylinder 36, the heat of the UV lamps 37 deforms the contamination-preventive member 55 mounted on the transport cylinder 36. In order to prevent this, if the contamination-preventive member 55 is mounted on the transport cylinder 36, the printing press is stopped.

The sheet with the UV inks dried is gripping-changed to the gripper of the impression cylinder 42 through the transfer cylinder 41 of the varnish coating unit 13, and coated with the UV varnish on its obverse as it passes between the impression cylinder 42 and blanket cylinder 40. Then, when the sheet is gripping-changed to the delivery gripper of the delivery chain 45 and conveyed, the UV lamps 48 of the ultraviolet drying device 49 dry the varnish-coated obverse of the sheet. After that, at the rear portion of the delivery device 6, the sheet is released from a delivery gripper (not shown) and stacked on a delivery pile (not shown).

When a predetermined number of sheets are printed, as the controller 85 detects that the operator has turned on the stop button 80 (YES in step S12), it counts that a predetermined period of time has passed (YES in step S13), and turns off the UV lamps 31, 37, and 48, and the UV lamps of the ultraviolet drying devices 50 and 51 (step S14). The controller 85 then opens the air nozzle valve 84. Thus, the air nozzle 72 sprays air from the discharge port 72*a* onto the detection surface 70*a* of the photoelectric sensor 70 for a predetermined period of time (step S15).

Also, upon detection that the operator has turned on the stop button 80 (YES in step S12), the controller 85 outputs a stop instruction to the motor 82 (step S16). Thus, the motor 82 stops driving (step S17).

A case of single-sided printing with the oil-based inks and water varnish will be described. After detection that the operator has turned on the single-sided printing button 75 (YES in step S1), the controller 85 does not detect that the UV lamp selection button 77 is turned on (NO in step S2) and detects that the IR lamp selection button 78 is turned on by the operator (YES in step S18). Upon detection that the operator turns on the driving button 79 (YES in step S20, FIG. 7C), the controller 85 drives the motor 85 (step S21).

If the drive button 79 is not turned on in step S20, the controller 85 repeats detection operation until detecting that the drive button 79 is turned on.

When the motor 82 starts driving, feed operation from the feed device 2 is started, and the respective blanket cylinders 18 of the printing units 7A to 7E and the blanket cylinder 23 of the varnish coating unit 8 are sequentially impression thrown-on. Then, before the first sheet fed from the feed device 2 is conveyed to the infrared drying device 9, the controller 85 turns on the IR lamps 28 and 46 (step S22).

In this state, the sheet fed from the feed device 2 onto the feeder board 52 is conveyed on the feeder board 52 by a belt (not shown). Then, the sheet is registered at its leading edge and in the widthwise direction, gripped by the gripper of the swing arm shaft pregripper 53, and gripping-changed to the gripper of the transfer cylinder 54. The sheet that has been gripping-changed to the gripper of the transfer cylinder 54 is gripping-changed to the gripper of the impression cylinder 19 of the printing unit 7A and conveyed. When the sheet passes between the impression cylinder 19 and blanket cylinder 18, its obverse is printed with the oil-based ink in the first color.

After that, when the sheet passes between the respective impression cylinders 19 and blanket cylinders 18 of the printing units 7B to 7E, its obverse is sequentially printed with oil-based inks in four colors. The sheet transferred from the impression cylinder 19 of the printing unit 7E to the transfer cylinder 25 of the varnish coating unit 8 is gripping-changed by the gripper of the transfer cylinder 24. When the sheet passes between the transfer cylinder 24 and blanket cylinder 23, its obverse is coated with the water varnish.

The sheet with the varnish-coated obverse is gripping-changed to the gripper of the transport cylinder 27 through the transfer cylinder 26 of the infrared drying device 9. After that, when the transport cylinder 27 conveys the sheet, the IR lamps 28 of the infrared drying device 9 dry the oil-based inks and water varnish applied to the obverse of the sheet.

The sheet with the oil-based inks and water varnish dried is gripping-changed to the gripper of the transfer cylinder 32 of the convertible device 5 through the transfer cylinder 29 and transport cylinder 30 of the ultraviolet drying device 10. The sheet which is sequentially gripping-changed to the chuck cylinder 33 and convertible cylinder 34 is not turned over in the convertible device 5 and is gripping-changed to the gripper of the impression cylinder 19 of the first-color printing unit 11A of the liquid transfer device 4.

After that, when the sheet passes between the respective blanket cylinders 18 and impression cylinders 19 of the printing units 11A to 11E, its obverse is coated with the oil-based inks. The sheet coated with the oil-based inks is gripping-changed to the gripper of the transport cylinder 36 through the transfer cylinder 35 of the ultraviolet drying device 12.

The sheet that has been gripping-changed from the transport cylinder 36 to the gripper of the impression cylinder 42 through the transfer cylinder 41 of the varnish coating unit 13 is coated with the water varnish on its obverse as it passes between the impression cylinder 42 and blanket cylinder 40. When the sheet is gripping-changed to the delivery gripper of the delivery chain 45 and conveyed, the IR lamps 46 of the infrared drying device 47 dry the obverse of the sheet which is coated with the oil-based inks and water varnish. After that, the sheet is released from the delivery gripper (not shown) at the rear portion of the delivery device 6, and stacked on the delivery pile (not shown).

When a predetermined number of sheets are printed, as the controller 85 detects that the operator has turned on the stop button 80 (YES in step S22), it counts that a predetermined period of time has passed (YES in step S24), and turns off the IR lamps 28 and 46 (step S25). The controller 85 then opens the air nozzle valve 84. Thus, the air nozzle 72 sprays air from the discharge port 72*a* onto the detection surface 70*a* of the photoelectric sensor 70 for a predetermined period of time (step S26).

Also, upon detection that the operator has turned on the stop button 80 (YES in step S22), the controller 85 outputs a stop instruction to the motor 82 (step S27). Thus, the motor 82 stops driving (step S28).

In this manner, in the case of single-sided printing with the oil-based inks and water varnish, the printing unit 11 need not print the reverse of the sheet. Accordingly, the transport cylinder 36 is not subjected to backing printing, so the contamination-preventive member 55 need not be mounted on the transport cylinder 36. Even if the contamination-preventive member 55 is mounted on the transport cylinder 36, the UV lamps 37 are not turned on. Therefore, the contamination-preventive member 55 mounted on the transport cylinder 36 will not be deformed. Accordingly, no problem arises even if the contamination-preventive member 55 is mounted, so that detection of the contamination-preventive member 55 by the photoelectric sensor 70 becomes unnecessary.

A case of double-sided printing with the UV inks and UV varnish will be described. In this case, the controller 85 does not detect that the single-sided printing button 75 is turned on (NO in step S1, FIG. 7A), and detects that the double-sided printing button 76 is turned on by the operator (YES in step S29). In step S29, if ON of the double-sided printing button 76 is not detected, the controller 85 repeats the processes of steps S1 and S29 until detecting that the double-sided printing button 76 is turned on.

Then, the controller 85 detects that the operator has turned on the UV lamp selection button 77 (YES in step S30). Upon detection that the operator has turned on the drive button 79 (YES in step S3, FIG. 7B), the controller 85 drives the motor 82 (step S4). In step S3, if the drive button 79 is not turned on, the controller 85 repeats the detection operation until detecting that the drive button 79 is turned on. When the motor 82 starts driving, the feed operation from the feed device 2 is started. The respective blanket cylinders 18 of the printing units 7A to 7E and the blanket cylinder 23 of the varnish coating unit 8 are sequentially impression thrown-on, and the respective blanket cylinders 18 of the printing units 11A to 11E and the blanket cylinder 40 of the varnish coating unit 13 are sequentially impression thrown-on.

When the motor 82 is driven and the printing press has reached a predetermined slower speed which is slower than the printing speed, the controller 85 checks whether or not the photoelectric sensor 70 is currently capable of detecting the outer surface of the transport cylinder 36 (step S5). More specifically, on the basis of the detection by the encoder 81 of the rotational angle of the printing press, the controller 85 checks the relationship between the notches 58 of the transport cylinder 36 and the detection surface 70*a* of the photoelectric sensor 70. If either notch 58 of the transport cylinder 36 opposes the detection surface 70*a* of the photoelectric sensor 70, the controller 85 determines that the photoelectric sensor 70 cannot detect the outer surface of the transport cylinder 36. The controller 85 repeats step S5 until detection of the outer surface of the transport cylinder 36 becomes possible.

The controller 85 advances to the next process when the photoelectric sensor 70 can detect the outer surface of the transport cylinder 36 (YES in step S5), that is, only when the region of the transport cylinder 36 other than the notches 58 opposes the detection surface 70*a* of the photoelectric sensor 70. In this manner, the notches 58 having a gloss different from that of the outer surface of the transport cylinder 36 may not be detected, so that erroneous detection of the outer surface of the transport cylinder 36 can be prevented.

When the controller 85 determines that the gloss detected by the photoelectric sensor 70 is lower than the reference gloss (YES in step S6), it determines that the contamination-preventive member 55 is mounted on the outer surface of the transport cylinder 36. The controller 85 actuates the alarm device 83 (step S7). Thus, the operator is informed of an alarm indicating that the contamination-preventive member 55 is left mounted on the outer surface of the transport cylinder 36. The controller 85 then opens the air nozzle valve 84, and the air nozzle 72 sprays air from the discharge port 72*a* onto the detection surface 70*a* of the photoelectric sensor 70 for a predetermined period of time (step S8).

Also, upon determination that the gloss detected by the photoelectric sensor 70 is lower than the reference gloss (step S6), the controller 85 outputs a stop instruction to the motor 82 (step S9). Thus, the motor 82 stops driving (step S10).

In this manner, if the contamination-preventive member 55 is left mounted on the outer surface of the transport cylinder 36, the printing press stops driving before the UV lamps 37 are turned on. Therefore, when the UV lamps 37 are turned on, heat generated by the UV lamps 37 will not deform the contamination-preventive member 55. Since the operator is informed of the alarm indicating that the contamination-preventive member 55 is left mounted on the outer surface of the transport cylinder 36, the down time of the printing press is minimized to prevent a decrease in productivity. Every time the printing press stops driving, air is sprayed onto the detection surface 70*a* of the photoelectric sensor 70, so the detection surface 70*a* can always be kept clean. Thus, erroneous detection by the photoelectric sensor 70 can be prevented.

When the controller 85 determines that the gloss detected by the photoelectric sensor 70 is higher than the reference gloss (NO in step S6), it determines that the contamination-preventive member 55 is not mounted on the outer surface of the transport cylinder 36. The controller 85 then turns on the UV lamps 31, 37, and 48, and the UV lamps of the ultraviolet drying devices 50 and 51 before the first sheet fed from the feed device 2 is conveyed to the printing unit 7C (step S11).

In this state, the sheet fed from the feed device 2 onto the feeder board 52 is conveyed on the feeder board 52 by a belt (not shown). Then, the sheet is registered at its leading edge and in the widthwise direction, gripped by the gripper of the swing arm shaft pregripper 53, and gripping-changed to the gripper of the transfer cylinder 54. The sheet that has been gripping-changed to the gripper of the transfer cylinder 54 is gripping-changed to the gripper of the impression cylinder 19 of the printing unit 7A and conveyed. When the sheet passes between the impression cylinder 19 and blanket cylinder 18, its obverse is printed with the UV ink in the first color.

After that, when the sheet passes between the respective impression cylinders 19 and blanket cylinders 18 of the printing units 7B to 7E, its obverse is sequentially printed with the UV inks in four colors.

When the sheet is conveyed by the impression cylinder 19 of the third-color printing unit 7C, the UV lamp of the ultraviolet drying device 50 dries the UV inks applied to the obverse of the sheet. When the sheet is conveyed by the impression cylinder 19 of the fifth-color printing unit 7E, the UV lamp of the ultraviolet drying device 51 dries the UV inks applied to the obverse of the sheet.

The sheet that has been transferred from the impression cylinder 19 of the printing unit 7E to the transfer cylinder 25 of the varnish coating unit 8 is gripping-changed by the gripper of the transfer cylinder 24. When the sheet passes between the transfer cylinder 24 and blanket cylinder 23, its obverse is coated with the UV varnish. The sheet with its obverse coated with the varnish is gripping-changed to the gripper of the transfer cylinder 26 of the infrared drying device 9, and to the gripper of the transport cylinder 30 through the transport cylinder 27 and the transfer cylinder 29 of the ultraviolet drying device 10.

Subsequently, when the transport cylinder 30 conveys the sheet, the UV lamps 31 dry the UV varnish. The sheet with the UV varnish dried is gripping-changed to the gripper of the transfer cylinder 32 of the convertible device 5. The sheet gripping-changed to the gripper of the transfer cylinder 32 is sequentially gripping-changed to the chuck cylinder 33 and convertible cylinder 34 of the convertible device 5. In the convertible device 5, the sheet is turned over, and gripping-changed to the gripper of the impression cylinder 19 of the first-color printing unit 11A of the liquid transfer device 4.

After that, the sheet is conveyed as it is sequentially gripping-changed to the respective impression cylinders 19 of the printing units 11A to 11E, and is sequentially coated with UV inks in five colors on its reverse as it passes between the respective impression cylinders 19 and blanket cylinders 18. When the sheet coated with the UV inks in five colors on its reverse is gripping-changed to the gripper of the transport cylinder 36 through the transfer cylinder 35 of the ultraviolet drying device 12, the UV lamps 37 dry the UV inks applied to the reverse of the sheet.

The sheet with the UV inks applied to the reverse and dried by the UV lamps 37 is gripping-changed to the gripper of the impression cylinder 42 through the transfer cylinder 41 of the varnish coating unit 13, and is coated with the UV varnish on its reverse as it passes between the impression cylinder 42 and blanket cylinder 40. Then, when the sheet is gripping-changed to the delivery gripper of the delivery chain 45 and conveyed, the UV lamps 48 of the ultraviolet drying device 49 dry the UV inks and UV varnish on the reverse of the sheet. Then, the sheet is released from the delivery gripper (not shown) at the rear portion of the delivery device 6, and stacked on the delivery pile (not shown).

When performing double-sided printing with the UV inks and UV varnish in this manner, the obverse of the sheet which has been printed by the printing unit 7 opposes the outer surface of the transport cylinder 36. At this time, as the obverse of the sheet has been dried by the ultraviolet drying devices 50 and 51, no problem arises even if contamination-preventive member 55 is not mounted on the transport cylinder 36. If the contamination-preventive member 55 is mounted on the transport cylinder 36, when the UV lamps 37 are turned on, the heat of the UV lamps 37 may deform the contamination-preventive member 55. Accordingly, in this case, the contamination-preventive member 55 should not be mounted on the transport cylinder 36, and the printing press stops driving.

When a predetermined number of sheets are printed, as the controller 85 detects that the operator has turned on the stop button 80 (YES in step S12), it counts that a predetermined period of time has passed (YES in step S13), and turns off the UV lamps 31, 37, and 48, and the UV lamps of the ultraviolet drying devices 50 and 51 (step S14). The controller 85 then opens the air nozzle valve 84. Thus, the air nozzle 72 sprays air from the discharge port 72*a* onto the detection surface 70*a* of the photoelectric sensor 70 for a predetermined period of time (step S15).

Also, upon detection that the operator has turned on the stop button 80 (YES in step S22), the controller 85 outputs a stop instruction to the motor 82 (step S16). Thus, the motor 82 stops driving (step S17).

A case of double-sided printing with the oil-based inks and water varnish will be described. In this case, the controller 85 does not detect that the single-sided printing button 75 is turned on (NO in step S1), and detects that the operator has turned on the double-sided printing button 76 (YES in step S29).

Then, the controller 85 does not detect that the UV lamp selection button 77 is turned on (NO in step S30), and detects that the operator has turned on the IR lamp selection button 78 (step S31). In step S31, if ON of the IR lamp selection button 78 is not detected, the controller 85 repeats the processes of steps S30 and S31 until detecting that the IR lamp selection button 78 is turned on.

Then, upon detection that the operator has turned on the drive button 79 (step S32 in FIG. 7D), the controller 85 drives the motor 82 (step S33). In step S32, if the drive button 79 is not turned on, the controller 85 repeats the detection operation until detecting that the drive button 79 is turned on. When the motor 82 starts driving, the feed operation from the feed device 2 is started. The respective blanket cylinders 18 of the printing units 7A to 7E and the blanket cylinder 23 of the varnish coating unit 8 are sequentially impression thrown-on, and the respective blanket cylinders 18 of the printing units 11A to 11E and the blanket cylinder 23 of the varnish coating unit 13 are sequentially impression thrown-on.

When the motor 82 is driven and the printing press has reached a predetermined slower speed which is slower than the printing speed, the controller 85 checks whether or not the photoelectric sensor 70 can detect the outer surface of the transport cylinder 36 (step S34). More specifically, on the basis of the rotational angle of the printing press detected by the encoder 81, the controller 85 checks whether or not either notch 58 of the transport cylinder 36 opposes the detection surface 70*a* of the photoelectric sensor 70. If either notch 58 opposes the detection surface 70*a*, the controller 85 determines that the photoelectric sensor 70 cannot detect the outer surface of the transport cylinder 36, and repeats the process of step S34 until the photoelectric sensor 70 can.

The controller 85 advances to the next process when the photoelectric sensor 70 can detect the outer surface of the transport cylinder 36 (YES in step S34), that is, only when the region of the transport cylinder 36 other than the notches 58 opposes the detection surface 70*a* of the photoelectric sensor 70. In this manner, as the notches 58 having a gloss different from that of the outer surface of the transport cylinder 36 may not be detected, so that erroneous detection of the outer surface of the transport cylinder 36 can be prevented.

Then, the controller 85 checks through the photoelectric sensor 70 whether or not the contamination-preventive member 55 is mounted on the outer surface of the transport cylinder 36 (step S35). Upon detection that the contamination-preventive member 55 is mounted (YES in step S35), the controller 85 turns on the IR lamps 28 and 46 before the first sheet fed from the feed device 2 is conveyed to the ultraviolet drying device 10 (step S36).

In this state, the sheet fed from the feed device 2 onto the feeder board 52 is conveyed on the feeder board 52 by a belt (not shown). Then, the sheet is registered at its leading edge and in the widthwise direction, gripped by the gripper of the swing arm shaft pregripper 53, and gripping-changed to the gripper of the transfer cylinder 54. The sheet that has been gripping-changed to the gripper of the transfer cylinder 54 is gripping-changed to the gripper of the impression cylinder 19 of the printing unit 7A and conveyed. When the sheet passes between the impression cylinder 19 and blanket cylinder 18, its obverse is printed with the oil-based ink in the first color.

After that, when the sheet passes between the respective impression cylinders 19 and blanket cylinders 18 of the printing units 7B to 7E, its obverse is sequentially printed with oil-based inks in four colors. The sheet transferred from the impression cylinder 19 of the printing unit 7E to the transfer cylinder 25 of the varnish coating unit 8 is gripping-changed by the gripper of the transfer cylinder 24, and is coated with the water varnish on its obverse as it passes between the impression cylinder 24 and blanket cylinder 23.

When the sheet with the varnish-coated obverse is gripping-changed to the transport cylinder 27 through the transfer cylinder 26 of the infrared drying device 9 and conveyed, the IR lamps 28 dry the oil-based inks and water varnish applied to the obverse of the sheet. The dried sheet is gripping-changed to the gripper of the transfer cylinder 32 of the convertible device 5 through the transfer cylinder 29 and transport cylinder 30 of the ultraviolet drying device 10.

The sheet gripping-changed to the gripper of the transfer cylinder 32 is gripping-changed to the chuck cylinder 33 and convertible cylinder 34, sequentially, of the convertible device 5, and is turned over in the convertible device 5. After that, the sheet is gripping-changed to the gripper of the impression cylinder 19 of the first-color printing unit 11A of the liquid transfer device 4. Then, the sheet is conveyed as it is sequentially gripping-changed to the respective impression cylinders 19 of the printing units 11A to 11E. When the sheet passes between the respective impression cylinders 19 and the corresponding blanket cylinders 18, it is sequentially coated with five-color oil-based inks on its reverse.

The sheet with the reverse coated with the oil-based inks in five colors is gripping-changed to the gripper of the impression cylinder 42 through the transfer cylinder 35 and transport cylinder 36 of the ultraviolet drying device 12 and the transfer cylinder 41 of the varnish coating unit 13. When the sheet passes between the impression cylinder 42 and blanket cylinder 40, it is coated with the water varnish on its reverse.

When the reverse of the sheet is to be subjected to printing and coating in the liquid transfer device 4 in this manner, if a mode in which the outer surface of the transport cylinder 36 opposes the ink or varnish on the conveyed sheet and the ink or varnish on the conveyed sheet is transferred to the outer surface of the transport cylinder 36, i.e., the transfer mode, is set, the contamination-preventive members 55 are mounted on the outer surfaces of the impression cylinders 19 of the printing units 11A to 11E, the transport cylinder 36 of the ultraviolet drying device 12, and the impression cylinder 42 of the varnish coating unit 13 in advance. Thus, the contamination-preventive members 55 prevent the oil-based inks and water varnish applied to the obverse of the sheet from attaching to the outer surfaces of the impression cylinders 19, transport cylinder 36, and impression cylinder 42.

Then, when the sheet is gripping-changed to the delivery gripper of the delivery chain 45 and conveyed, the IR lamps 46 of the infrared drying device 47 dry the oil-based inks and water varnish on the reverse of the sheet. After that, the sheet is released from the delivery gripper (not shown) at the rear portion of the delivery device 6, and is stacked on the delivery pile (not shown).

When a predetermined number of sheets are printed, as the controller 85 detects that the operator has turned on the stop button 80 (YES in step S37), it counts that a predetermined period of time has passed (YES in step S38), and turns off the IR lamps 28 and 46 (step S39). The controller 85 then opens the air nozzle valve 84. Thus, the air nozzle 72 sprays air from the discharge port 72*a* onto the detection surface 70*a* of the photoelectric sensor 70 for a predetermined period of time (step S40).

Also, upon detection that the operator has turned on the stop button 80 (YES in step S37), the controller 85 outputs a stop instruction to the motor 82 (step S41). Thus, the motor 82 stops driving (step S42).

When the controller 85 determines that the gloss detected by the photoelectric sensor 70 is higher than the reference gloss (NO in step S35), it determines that the contamination-preventive member 55 is not mounted on the outer surface of the transport cylinder 36. Then, the controller 85 actuates the alarm device 83 (step S43). Thus, the operator is informed of an alarm indicating that the contamination-preventive member 55 is not mounted on the outer surface of the transport cylinder 36. The controller 85 then opens the air nozzle valve 84, and the air nozzle 72 sprays air from the discharge port 72*a* onto the detection surface 70*a* of the photoelectric sensor 70 for a predetermined period of time (step S44).

Also, upon determination that the gloss detected by the photoelectric sensor 70 satisfies the reference gloss (NO in step S35), the controller 85 outputs a stop instruction to the motor 82 (step S45). Thus, the motor 82 stops driving (step S46).

In this manner, if it is detected that the contamination-preventive member 55 is not mounted on the outer surface of the transport cylinder 36, the printing press stops driving before the IR lamps 28 and 46 are turned on. Thus, even if the operator forgets to mount the contamination-preventive member 55, the oil-based inks and water varnish applied to the obverse of the sheet are prevented from attaching to the outer surfaces of the impression cylinders 19 of the printing units 11A to 11E, the transport cylinder 36 of the ultraviolet drying device 12, and the impression cylinder 42 of the varnish coating unit 13.

In this manner, in double-sided printing with the oil-based inks and water varnish, the UV lamps 37 are not used and are accordingly kept off. Therefore, the problem that the heat of the UV lamps 37 deforms the contamination-preventive member 55 erroneously mounted on the outer surface of the transport cylinder 36 does not arise. Since the obverse of the sheet printed by the printing unit 7 opposes the transport cylinder 36, the contamination-preventive member 55 must be mounted so the outer surface of the transport cylinder 36 will not be contaminated. Therefore, if the contamination-preventive member 55 is not mounted on the outer surface of the transport cylinder 36, the printing press is stopped.

The second embodiment of the present invention will be described with reference to FIGS. 8A to 8C and 7B to 7D. This embodiment is different from the first embodiment in that whether the contamination-preventive member is mounted on the outer surface of the transport cylinder is detected while the printing press is stopped.

First, a case of single-sided printing with the UV ink and UV varnish will be described. While a motor 82 is not driving, a controller 85 detects that a single-sided printing button 75 is turned on (YES in step S51, FIG. 8A), and detects that a UV lamp selection button 77 is turned on by the operator (YES in step S52). When a photoelectric sensor 70 can detect the outer surface of a transport cylinder 36 (YES in step S53, FIG. 8B), that is, based on the detection by an encoder 81 of the rotational angle of the printing press, the controller 85 determines that the region of the transport cylinder 36 other than notches 58 opposes a detection surface 70*a* of the photoelectric sensor 70.

When the controller 85 determines that the gloss detected by the photoelectric sensor 70 is lower than the reference gloss (YES in step S54), it determines that a contamination-preventive member 55 is mounted on the outer surface of the transport cylinder 36. Then, the controller 85 actuates an alarm device 83 (step S55). Thus, the operator is informed of an alarm indicating that the contamination-preventive member 55 is left mounted on the outer surface of the transport cylinder 36. The controller 85 then opens an air nozzle valve 84, and an air nozzle 72 sprays air from a discharge port 72*a* onto the detection surface 70*a* of the photoelectric sensor 70 for a predetermined period of time (step S56).

When the photoelectric sensor 70 cannot detect the outer surface of the transport cylinder 36 (NO in step S53), that is, based on the detection by the encoder 81 of the rotational angle of the printing press, the controller 85 determines that either notch 58 of the transport cylinder 36 opposes the detection surface 70*a* of the photoelectric sensor 70. In this case, the controller 85 performs the operation of steps S3 to S17 in FIG. 7B. When the controller 85 determines that the gloss detected by the photoelectric sensor 70 is higher than the reference gloss (NO in step S54), it determines that the contamination-preventive member 55 is not mounted on the outer surface of the transport cylinder 36. In this case, the controller 85 performs the operation of steps S3 to S17 in FIG. 7B.

In this manner, when performing single-sided printing with the UV ink and UV varnish, if the contamination-preventive member 55 is left mounted on the outer surface of the transport cylinder 36, the printing press stops driving before UV lamps 37 are turned on. When the contamination-preventive member 55 is not mounted on the transport cylinder 36, the printing press operates.

A case of single-sided printing with the oil-based inks and water varnish will be described next. After detection that the operator has turned on the single-sided printing button 75 (YES in step S51), the controller 85 does not detect that the UV lamp selection button 77 is turned on (NO in step S52), and detects that an IR lamp selection button 78 is turned on by the operator (YES in step S57). The controller 85 then performs the operation of steps S20 to S28 in FIG. 7C.

In this manner, when performing single-sided printing with the oil-based inks and water varnish, if it is detected that the contamination-preventive member 55 is not mounted on the outer surface of the transport cylinder 36, the printing press stops driving before IR lamps 28 and 46 are turned on. When the contamination-preventive member 55 is mounted on the transport cylinder 36, the printing press operates.

A case of double-sided printing with the UV inks and UV varnish will be described next. In this case, the controller 85 does not detect that the single-sided printing button 75 is turned on (NO in step S51, FIG. 8A), and detects that the double-sided printing button 76 is turned on by the operator (YES in step S58). In step S59, if ON of the double-sided printing button 76 is not detected, the controller 85 repeats the processes of steps S51 and S58 until detecting that the double-sided printing button 76 is turned on.

Then, the controller 85 detects that the operator has turned on the UV lamp selection button 77 (YES in step S59). When the photoelectric sensor 70 can detect the outer surface of the transport cylinder 36 (YES in step S53, FIG. 8B), that is, based on the detection by the encoder 81 of the rotational angle of the printing press, the controller 85 determines that the region of the transport cylinder 36 other than the notches 58 opposes the detection surface 70*a* of the photoelectric sensor 70.

When the controller 85 determines that the gloss detected by the photoelectric sensor 70 is lower than the reference gloss (YES in step S54), it determines that the contamination-preventive member 55 is mounted on the outer surface of the transport cylinder 36. Then, the controller 85 actuates the alarm device 83 (step S55). Thus, the operator is informed of an alarm indicating that the contamination-preventive member 55 is left mounted on the outer surface of the transport cylinder 36. The controller 85 then opens the air nozzle valve 84, and the air nozzle 72 sprays air from the discharge port 72*a* onto the detection surface 70*a* of the photoelectric sensor 70 for a predetermined period of time (step S56).

When the photoelectric sensor 70 cannot detect the outer surface of the transport cylinder 36 (NO in step S53), that is, based on the detection by an encoder 81 of the rotational angle of the printing press, the controller 85 determines that either notch 58 of the transport cylinder 36 opposes the detection surface 70*a* of the photoelectric sensor 70. In this case, the controller 85 performs the operation of steps S3 to S17 in FIG. 7B. When the controller 85 determines that the gloss detected by the photoelectric sensor 70 is higher than the reference gloss (NO in step S54), it determines that the contamination-preventive member 55 is not mounted on the outer surface of the transport cylinder 36. In this case, the controller 85 performs the operation of steps S3 to S17 in FIG. 7B.

In this manner, when performing double-sided printing with the UV ink and UV varnish, if the contamination-preventive member 55 is left mounted on the outer surface of the transport cylinder 36, the printing press stops driving before the UV lamps 37 are turned on. When the contamination-preventive member 55 is not mounted on the transport cylinder 36, the printing press operates.

A case of double-sided printing with the oil-based inks and water varnish will be described next. In this case, the controller 85 does not detect that the single-sided printing button 75 is turned on (NO in step S51, FIG. 8A), and detects that the double-sided printing button 76 is turned on by the operator (YES in step S58).

The controller 85 does not detect that the UV lamp selection button 77 is turned on (NO in step S59) and detects that the IR lamp selection button 78 is turned on by the operator (YES in step S60). In step S60, if ON of the IR lamp selection button 78 is not detected, the controller 85 repeats the processes of steps S59 and S60 until detecting that the IR lamp selection button 78 is turned on.

When the photoelectric sensor 70 can detect the outer surface of the transport cylinder 36 (YES in step S61, FIG. 8C), that is, based on the detection by the encoder 81 of the rotational angle of the printing press, the controller 85 determines that the region of the transport cylinder 36 other than the notches 58 opposes the detection surface 70*a* of the photoelectric sensor 70.

When the controller 85 determines that the gloss detected by the photoelectric sensor 70 is higher than the reference gloss (YES in step S62), it determines that the contamination-preventive member 55 is mounted on the outer surface of the transport cylinder 36. In this case, the controller 85 performs the operation of steps S32 to S46 in FIG. 7D.

When the photoelectric sensor 70 cannot detect the outer surface of the transport cylinder 36 (NO in step S61), that is, based on the detection by the encoder 81 of the rotational angle of the printing press, the controller 85 determines that either notch 58 of the transport cylinder 36 opposes the detection surface 70*a* of the photoelectric sensor 70. In this case, the controller 85 performs the operation of steps S32 to S46 in FIG. 7D.

When the controller 85 determines that the gloss detected by the photoelectric sensor 70 is higher than the reference gloss (NO in step S62), it determines that the contamination-preventive member 55 is not mounted on the outer surface of the transport cylinder 36. In this case, the controller 85 actuates the alarm device 83 (step S63). Thus, the operator is informed of an alarm indicating that the contamination-preventive member 55 is not mounted on the outer surface of the transport cylinder 36. The controller 85 then opens the air nozzle valve 84, and the air nozzle 72 sprays air from the discharge port 72*a* onto the detection surface 70*a* of the photoelectric sensor 70 for a predetermined period of time (step S64).

In this manner, when performing double-sided printing with the UV ink and UV varnish, if it is detected that the contamination-preventive member 55 is not mounted on the outer surface of the transport cylinder 36, the printing press stops driving before the IR lamps 28 and 46 are turned on. When the contamination-preventive member 55 is mounted on the transport cylinder 36, the printing press operates.

The third embodiment of the present invention will be described with reference to FIG. 9. A double-sided sheet-fed rotary printing press 101 according to the third embodiment is different from that of the first embodiment in that it is not provided with a convertible device, and that obverse printing and reverse printing are performed alternately and obverse coating and reverse coating are performed simultaneously.

Figure 9:
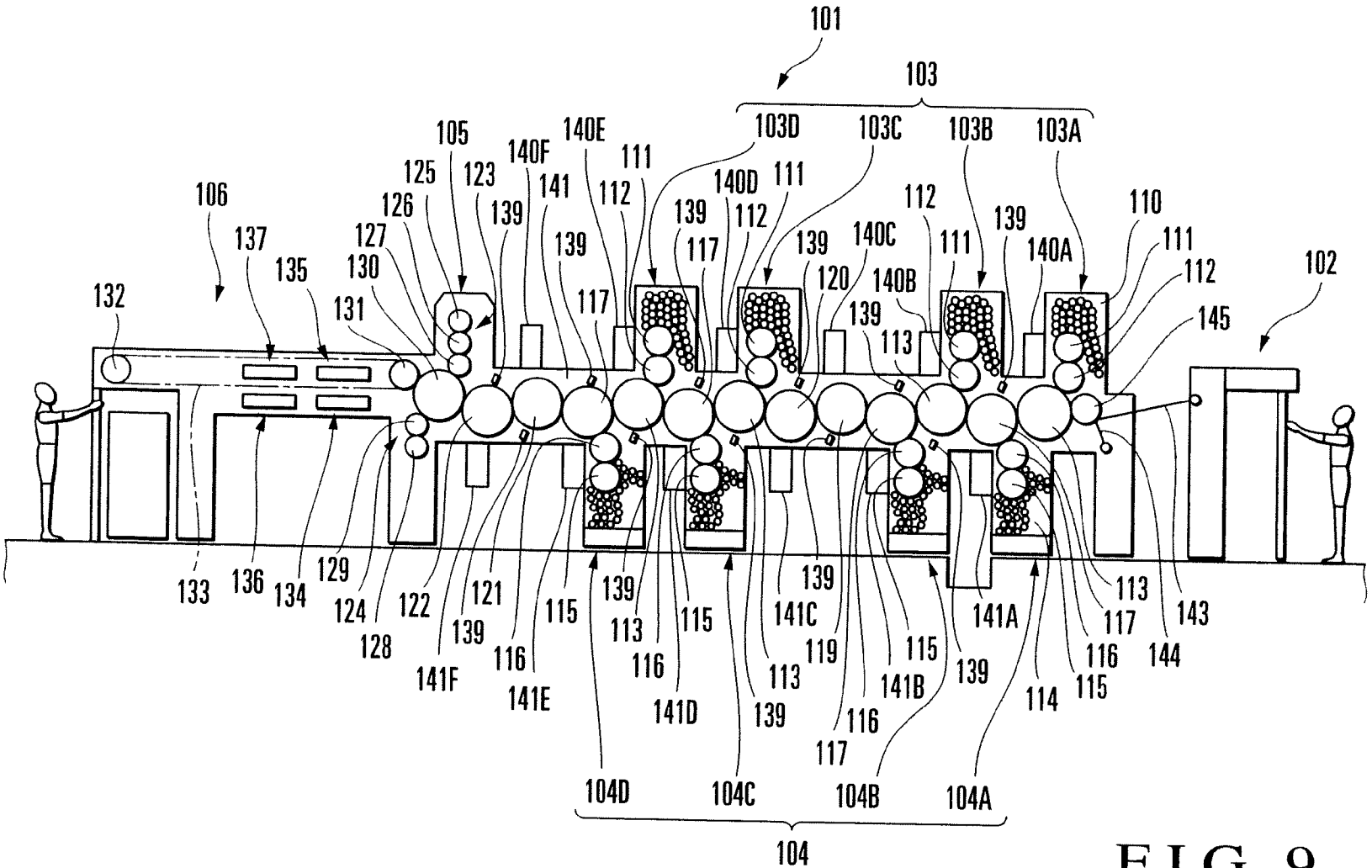
FIG. 9 is a view showing the cylinder layout in the third embodiment of the present invention.

As shown in FIG. 9, the double-sided sheet-fed rotary printing press 101 includes a feed device 102 which feeds sheets one by one, a first printing unit 103 including four sets of printing units 103A to 103D which print the obverse of the sheet, a second printing unit 104 including four sets of printing units 104A to 104D which print the reverse of the sheet, a varnish coating unit 105 which coats the obverse and reverse of the sheet with varnish simultaneously, and a delivery device 106 which delivers the varnish-coated sheet.

Each of the printing units 103A to 103D includes a plate cylinder 111 provided with an inking device and a dampening device 110, a blanket cylinder 112 arranged to oppose the plate cylinder 111, and an impression cylinder 113 arranged to oppose the blanket cylinder 112. Each of the printing units 104A to 104D includes a plate cylinder 115 provided with an inking device and a dampening device 114, a blanket cylinder 116 arranged to oppose the plate cylinder 115, and an impression cylinder 117 arranged to oppose the blanket cylinder 116.

The impression cylinder 113 of the printing unit 103A opposes the impression cylinder 117 of the printing unit 104A, and the impression cylinder 117 of the printing unit 104A opposes the impression cylinder 113 of the printing unit 103B. The impression cylinder 113 of the printing unit 103B opposes the impression cylinder 117 of the printing unit 104B. A transfer cylinder 119 and a transport cylinder 120 are interposed between the impression cylinder 117 of the printing unit 104B and the impression cylinder 113 of the printing unit 103C.

The impression cylinder 113 of the printing unit 103C opposes the impression cylinder 117 of the printing unit 104C, and the impression cylinder 117 of the printing unit 104C opposes the impression cylinder 113 of the printing unit 103D.

The varnish coating unit 105 includes a first varnish coating unit 123 which coats the obverse of the sheet with varnish, and a second varnish coating unit 124 which coats the reverse of the sheet with the varnish. The first varnish coating unit 123 includes an upper anilox roller 125 to which a chamber coater (not shown) supplies the varnish, a plate cylinder 126 which opposes the upper anilox roller 125 and to which the upper anilox roller 125 transfers the varnish, and an upper blanket cylinder 127 which opposes the plate cylinder 126.

The second varnish coating unit 124 includes a lower anilox roller 128 to which a chamber coater (not shown) supplies the varnish, a lower blanket cylinder 129 which opposes the lower anilox roller 128 and to which the lower anilox roller 128 transfers the varnish, and a blanket cylinder 130 which opposes the lower blanket cylinder 129 and which conveys the sheet transferred from the blanket cylinder 116 of the printing unit 104D. A transfer cylinder 121 and a transport cylinder 122 are interposed between the blanket cylinder 130 and the impression cylinder 117 of the printing unit 104D.

The delivery device 106 includes a sprocket 131 provided coaxially with a delivery cylinder (not shown) opposing the blanket cylinder 130 of the varnish coating unit 105, and a delivery chain 133 looped between the sprocket 131 and a sprocket 132 provided at the rear portion of the delivery device 106. Infrared drying devices 134 and 135 and ultraviolet drying devices 136 and 137 are arranged close to the convey path of the delivery chain 133.

Photoelectric sensors 139 are arranged close to the respective outer surfaces of the impression cylinders 113 of the printing units 103B to 103D, the impression cylinders 117 of the printing units 104A to 104D, the transfer cylinders 119 and 121, and the transport cylinders 120 and 122. In the same manner as the photoelectric sensor 70 in the first embodiment, the photoelectric sensors 139 detect the glosses of the respective outer surfaces of the impression cylinders 113 and 117, transfer cylinders 119 and 121, and transport cylinders 120 and 122 as the detection target bodies from the light reflected by them.

Ultraviolet drying devices 140A to 140F dry the UV inks and UV varnish applied to the obverse of the sheet conveyed by the impression cylinders 113 of the printing units 103A to 103D and the transfer cylinders 119 and 121. Ultraviolet drying devices 141A to 141F dry the UV inks and UV varnish applied to the reverse of the sheet conveyed by the impression cylinders 117 of the printing unit 104A to 104D and the transport cylinders 120 and 122.

The respective photoelectric sensors 139 oppose the corresponding ultraviolet drying devices 140A to 140F and 141A to 141F through the corresponding cylinders 117, 113, 119, 120, 121, and 122. With this arrangement, the respective cylinders 117, 113, 119, 120, 121, and 122 block the light emitted from the corresponding ultraviolet drying devices 140A to 140F and 141A to 141F and the heat generated by them during a drying operation. Accordingly, the photoelectric sensors 139 themselves will not fail. In addition, the respective photoelectric sensors 139 are arranged to oppose the corresponding cylinders 117, 113, 119, 120, 121, and 122 and positioned such that they are not affected by the light emitted from the ultraviolet drying devices 140A to 140F and 141A to 141F. Since the photoelectric sensors 139 are positioned such that they do not receive the light emitted from the ultraviolet drying devices 140A to 140 and 141A to 141F, they will not be damaged.

The respective photoelectric sensors 139 are arranged upstream, in the rotation direction of the corresponding cylinders 117, 113, 119, 120, 121 and 122, of the transfer position at which the upstream cylinder transfers the sheet to the corresponding cylinders 117, 113, 119, 120, 121, and 122, and downstream, in the rotation direction of the corresponding cylinders 117, 113, 119, 120, 121, and 122, of the reception position at which the downstream cylinder receives the sheet from the corresponding cylinders 117, 113, 119, 120, 121, and 122, and opposes the corresponding cylinders 117, 113, 119, 120, 121, and 122. Since the photoelectric sensors 139 are not arranged in the convey path of the sheet which is conveyed by the cylinders 117, 113, 119, 120, 121, and 122, the photoelectric sensors 139 can reliably detect the presence/ absence of contamination-preventive members 55 mounted on the cylinders 117, 113, 119, 120, 121, and 122.

The drying operation of the double-sided sheet-fed rotary printing press having the above arrangement will be described. A case that uses oil-based inks and water varnish will be described first. In this case, the operator mounts the contamination-preventive members 55 on the respective outer surfaces of the impression cylinders 113 of the printing units 1038 to 103D, the impression cylinders 117 of the printing units 104A to 104D, the transfer cylinders 119 and 121, and the transport cylinders 120 and 122.

In this state, the IR lamps of the infrared drying devices 134 and 135 are turned on, and printing is started. A sheet fed from the feed device 102 onto a feeder board 143 is conveyed on the feeder board 143 by a belt (not shown). Then, the sheet is registered at the leading edge and in the widthwise direction, gripped by the gripper of a swing arm shaft pregripper 144, and gripping-changed to the gripper of a transfer cylinder 145. The sheet that has been gripping-changed to the gripper of the transfer cylinder 145 is gripping-changed to the gripper of the impression cylinder 113 of the printing unit 103A and conveyed. When the sheet passes between the impression cylinder 113 and blanket cylinder 112, its obverse is subjected to printing with the oil-based ink in the first color.

Subsequently, when the sheet gripping-changed to the gripper of the impression cylinder 117 of the printing unit 104A passes between the impression cylinder 117 and blanket cylinder 116, its reverse is subjected to first-color printing with the oil-based ink. After that, the sheet is sequentially subjected to printing in three colors on its obverse and reverse alternately by the printing units 103B to 103D and printing units 104B to 104D.

In this case, the contamination-preventive members 55 mounted on the outer surfaces of the impression cylinders 113 of the printing units 103B to 103D, the impression cylinders 117 of the printing units 104A to 104D, the transfer cylinders 119 and 121, and the transport cylinders 120 and 122 prevent the outer surfaces of the respective cylinders from being contaminated by the inks. The sheet with the obverse and reverse that are printed is subjected to coating on the obverse and reverse by the varnish coating unit 105 with the water varnish. After that, when the delivery chain 133 conveys the sheet, the sheet is dried by the infrared drying devices 134 and 135 and delivered onto the delivery pile.

A case that uses UV inks and UV varnish will be described. If the printing press is driven with the contamination-preventive members 55 being left mounted on the outer surfaces of the impression cylinders 113 of the printing units 103B to 103D, the impression cylinders 117 of the printing unit 104A to 104D, the transfer cylinders 119 and 121, and the transport cylinders 120 and 122, the photoelectric sensors 139 detect the contamination-preventive members 55. Thus, the printing press stops driving before the respective UV lamps of the ultraviolet drying devices 140A to 140F and 141A to 141F are turned on. Therefore, heat of the respective UV lamps of the ultraviolet drying devices 140A to 140F and 141A to 141F does not deform the contamination-preventive members 55 mounted on the respective outer surfaces of the impression cylinders 113 of the printing units 103B to 103D, the impression cylinders 117 of the printing unit 104A to 104D, the transfer cylinders 119 and 121, and the transport cylinders 120 and 122.

If the contamination-preventive members 55 are not mounted on the respective outer surfaces of the impression cylinders 113 of the printing units 103B to 103D, the impression cylinders 117 of the printing unit 104A to 104D, the transfer cylinders 119 and 121, and the transport cylinders 120 and 122, the respective UV lamps of the ultraviolet drying devices 136, 137, 140A to 140F, and 141A to 141F are turned on, and printing is started. Hence, the sheet fed from the feed device 102 onto the feeder board 143 is conveyed on the feeder board 143 by a belt (not shown). Then, the sheet is registered at the leading edge and in the widthwise direction, gripped by the gripper of the swing arm shaft pregripper 144, and gripping-changed to the gripper of the transfer cylinder 145.

The sheet that has been gripping-changed to the gripper of the transfer cylinder 145 is gripping-changed to the gripper of the impression cylinder 113 of the printing unit 103A and conveyed. When the sheet passes between the blanket impression cylinder 113 and blanket cylinder 112, its obverse is subjected to printing with the UV ink in the first color. When the sheet that underwent the first-color printing on the obverse by the printing unit 103A is conveyed by the impression cylinder 113 of the printing unit 103A, the UV lamp of the ultraviolet drying device 140A dries the UV ink applied to the obverse. In this case, as the UV ink drying speed of the UV lamp of the ultraviolet drying device 140A is high, no problem arises even if the contamination-preventive member 55 is not mounted on the outer surface of the impression cylinder 117 of the printing unit 104A to which the sheet is gripping-changed from the impression cylinder 113 of the printing unit 103A.

Subsequently, when the sheet gripping-changed to the gripper of the impression cylinder 117 of the printing unit 104A passes between the impression cylinder 117 and blanket cylinder 116, its reverse is subjected to first-color printing with the UV ink. When the sheet that underwent the first-color printing on the reverse by the printing unit 104A is conveyed by the impression cylinder 117 of the printing unit 104A, the UV lamp of the ultraviolet drying device 141A dries the UV ink applied to the reverse. In this case, as the UV ink drying speed of the UV lamp of the ultraviolet drying device 141A is high, no problem arises even if the contamination-preventive member 55 is not mounted on the outer surface of the impression cylinder 113 of the printing unit 103B to which the sheet is gripping-changed from the impression cylinder 117 of the printing unit 104A.

Subsequently, when the sheet gripping-changed to the gripper of the impression cylinder 113 of the printing unit 103B passes between the impression cylinder 113 and blanket cylinder 112, its obverse is subjected to second-color printing with the UV ink. When the sheet that underwent the second-color printing on the obverse by the printing unit 103B is conveyed by the impression cylinder 113 of the printing unit 103B, the UV lamp of the ultraviolet drying device 140B dries the UV ink applied to the obverse. In this case, as the UV ink drying speed of the UV lamp of the ultraviolet drying device 140B is high, no problem arises even if the contamination-preventive member 55 is not mounted on the outer surface of the impression cylinder 117 of the printing unit 104B to which the sheet is gripping-changed from the impression cylinder 113 of the printing unit 103B.

Subsequently, when the sheet gripping-changed to the gripper of the impression cylinder 117 of the printing unit 104B passes between the impression cylinder 117 and blanket cylinder 116, its reverse is subjected to second-color printing with the UV ink. When the sheet that underwent the second-color printing on the reverse by the printing unit 104B is conveyed by the impression cylinder 117 of the printing unit 104B, the UV lamp of the ultraviolet drying device 141B dries the UV ink applied to the reverse. In this case, as the UV ink drying speed of the UV lamp of the ultraviolet drying device 141B is high, no problem arises even if the contamination-preventive member 55 is not mounted on the outer surface of the transfer cylinder 119 to which the sheet is gripping-changed from the impression cylinder 117 of the printing unit 104B.

Furthermore, when the sheet is gripping-changed to the gripper of the transport cylinder 120 through the transfer cylinder 119 and conveyed, the UV lamps of the ultraviolet drying devices 140C and 141C respectively dry the UV inks applied to the obverse and reverse of the sheet. In this case, as the UV ink drying speed of the UV lamps of the ultraviolet drying devices 140C and 141C is high, no problem arises even if the contamination-preventive members 55 are not mounted on the outer surfaces of the transfer cylinder 120 and the impression cylinder 113 of the printing unit 1030.

When the sheet that underwent third-color printing on the obverse by the printing unit 103C is conveyed by the impression cylinder 113 of the printing unit 103C, the UV lamp of the ultraviolet drying device 140D dries the UV ink applied to the obverse. In this case, as the UV ink drying speed of the UV lamp of the ultraviolet drying device 140D is high, no problem arises even if the contamination-preventive member 55 is not mounted on the outer surface of the impression cylinder 117 of the printing unit 104C to which the sheet is gripping-changed from the impression cylinder 113 of the printing unit 103C.

Subsequently, when the sheet gripping-changed to the gripper of the impression cylinder 117 of the printing unit 104C passes between the impression cylinder 117 and blanket cylinder 116, its reverse is subjected to third-color printing with the UV ink. When the sheet that underwent the third-color printing on the reverse by the printing unit 104C is conveyed by the impression cylinder 117 of the printing unit 104C, the UV lamp of the ultraviolet drying device 141D dries the UV ink applied to the reverse. In this case, as the UV ink drying speed of the UV lamp of the ultraviolet drying device 1410 is high, no problem arises even if the contamination-preventive member 55 is not mounted on the outer surface of the impression cylinder 113 of the printing unit 103D to which the sheet is gripping-changed from the impression cylinder 117 of the printing unit 104C.

Subsequently, when the sheet gripping-changed to the gripper of the impression cylinder 113 of the printing unit 103D passes between the impression cylinder 113 and blanket cylinder 112, its obverse is subjected to fourth-color printing with the UV ink. When the sheet that underwent the fourth-color printing on the obverse by the printing unit 103D is conveyed by the impression cylinder 113 of the printing unit 103D, the UV lamp of the ultraviolet drying device 141E dries the UV ink applied to the obverse. In this case, as the UV ink drying speed of the UV lamp of the ultraviolet drying device 141E is high, no problem arises even if the contamination-preventive member 55 is not mounted on the outer surface of the impression cylinder 117 of the printing unit 104D to which the sheet is gripping-changed from the impression cylinder 113 of the printing unit 103D.

Subsequently, when the sheet gripping-changed to the gripper of the impression cylinder 117 of the printing unit 104D passes between the impression cylinder 117 and blanket cylinder 116, its reverse is subjected to fourth-color printing with the UV ink. When the sheet that underwent the fourth-color printing on the reverse by the printing unit 104D is conveyed by the impression cylinder 117 of the printing unit 104D, the UV lamp of the ultraviolet drying device 141E dries the UV ink applied to the reverse. In this case, as the UV ink drying speed of the UV lamp of the ultraviolet drying device 141E is high, no problem arises even if the contamination-preventive member 55 is not mounted on the outer surface of the transfer cylinder 121 to which the sheet is gripping-changed from the impression cylinder 117 of the printing unit 104D.

Furthermore, when the sheet is gripping-changed to the gripper of the transport cylinder 122 through the transfer cylinder 121 and conveyed, the UV lamps of the ultraviolet drying devices 140F and 141F respectively dry the UV inks applied to the obverse and reverse of the sheet. In this case, as the UV ink drying speed of the UV lamps of the ultraviolet drying devices 140F and 141F is high, no problem arises even if the contamination-preventive member 55 is not mounted on the outer surface of the transfer cylinder 122.

Subsequently, when the sheet is gripping-changed to the gripper of the transport cylinder 122 through the transfer cylinder 121 and conveyed, the UV lamps of the ultraviolet drying devices 140F and 141F respectively dry the UV inks applied to the obverse and reverse of the sheet. In this case, as the UV ink drying speed of the UV lamps of the ultraviolet drying devices 140F and 141F is high, no problem arises even if the contamination-preventive member 55 is not mounted on the outer surface of the transfer cylinder 122.

When the sheet on which the UV inks have been applied to the obverse and reverse and dried is gripping-changed to the gripper of the impression cylinder 130 of the varnish coating unit 105 through the transfer cylinder 122 and passes between the impression cylinder 130 and upper blanket cylinder 127, the obverse and reverse of the sheet are coated with the UV varnish. After that, when the delivery chain 133 conveys the sheet, the ultraviolet drying devices 136 and 137 dry the UV varnish, and the sheet is delivered onto the delivery pile.

Although this embodiment is exemplified by a convertible double-sided printing press, the present invention can also be applied to a single-sided printing press. More specifically, after the obverse of the sheet is printed, the reverse may be printed by the same single-sided printing press. In this case, the photoelectric sensors 70 are provided at positions close to the outer surfaces of the respective impression cylinders 19 of the printing units 7C and 7E corresponding to the UV lamps 50 and 51. The photoelectric sensors 70 detect mounting/non-mounting of the contamination-preventive members mounted on the outer surfaces of the respective impression cylinders 19 of the printing units 7C and 7E. Although a case of printing and coating a sheet is described, a web may be used in place of the sheet.

Although a printing press that dries the ink has been described, the present invention may be applied to a coating apparatus that dries varnish. Although water varnish is used as the varnish to be dried by the IR lamps, overprint varnish (OP varnish) may also be used. Although air is sprayed onto the detection surface 70*a* of the photoelectric sensor 70 after the corresponding operation is complete, it may be sprayed immediately before steps S3, S20, S32, S53, and S61, and various design modifications are possible.

The above-described embodiments have exemplified a case in which the photoelectric sensor 70 or 139 detects the light reflected by the detection target body (the outer surface of the transport cylinder, the surface of the contamination-preventive member) and the determination unit 85*a* of the controller 85 compares the detection signal level from the photoelectric sensor 70 or 139 with the reference level to determine mounting/non-mounting of the contamination-preventive member 55. In this case, the photoelectric sensors 70 and 139 and the determination unit 85*a* of the controller 85 form a sensor means in this invention. Note that when the photoelectric sensor has a determination function (determination unit), the output of the photoelectric sensor (sensor means) with the determination function may be directly used by the controller 85 as a signal that indicates mounting/non-mounting of the contamination-preventive member 55.

Mounting/non-mounting of the contamination-preventive member 55 is determined by comparing the reference gloss (reference reflected light) stored in the controller 85 in advance with the gloss (reflected light) detected by the photoelectric sensor 70 or 139. However, the light reflected by the outer surface of the transport cylinder and actually measured may be used in place of the reference reflected light.

The invention claimed is:

1. A liquid transfer apparatus comprising:

a transport cylinder which conveys a liquid transfer target body to which a liquid has been transferred;

a drying device which is arranged to oppose an outer surface of said transport cylinder and dries the liquid transferred to the liquid transfer target body on said transport cylinder;

a contamination-preventive member selectively mounted on the outer surface of said transport cylinder;

sensor means for detecting mounting/non-mounting of said contamination-preventive member on the outer surface of said transport cylinder; and a control device which controls said drying device in an inoperative state when said sensor means detects that said contamination-preventive member is mounted.

2. A liquid transfer apparatus according to claim 1, further comprising a driving device which drives said liquid transfer apparatus, wherein when said sensor means detects mounting of said contamination-preventive member, said control device stops said driving device.

3. A liquid transfer apparatus according to claim 1, further comprising a driving device which drives said liquid transfer apparatus, wherein said control device controls said driving device not to operate, when said sensor means detects that said contamination-preventive member is mounted.

4. A liquid transfer apparatus according to claim 1, wherein said drying device comprises an ultraviolet lamp, and the liquid transferred to the liquid transfer target body comprises one of ultraviolet ink and ultraviolet varnish which are dried by said ultraviolet lamp.

5. A liquid transfer apparatus according to claim 4, further comprising:

a driving device which drives said liquid transfer apparatus; and an infrared lamp, wherein the liquid transferred to the liquid transfer target body comprises one of ink and varnish which are dried by said infrared lamp, and in a transfer mode in which the outer surface of said transport cylinder opposes one of the ink and the varnish on the liquid transfer target body, when said sensor means detects that said contamination-preventive member is not mounted, the operation of said driving device is stopped.

6. A liquid transfer apparatus according to claim 4, further comprising:

a driving device which drives said liquid transfer apparatus; and an infrared lamp, wherein the liquid transferred to the liquid transfer target body comprises one of ink and varnish which are dried by said infrared lamp, and in a transfer mode in which the outer surface of said transport cylinder opposes one of the ink and the varnish on the liquid transfer target body, said drying device is not operated, when said sensor means detects that said contamination-preventive member is not mounted.

7. A liquid transfer apparatus according to claim 1, further comprising:

an upstream liquid transfer device which transfers the liquid to the liquid transfer target body;

a downstream liquid transfer device which transfers the liquid to the liquid transfer target body; and a convertible device which is arranged between said upstream liquid transfer device and said downstream liquid transfer device and turns over the liquid transfer target body selectively.

8. A liquid transfer apparatus according to claim 7, wherein said upstream liquid transfer device transfers the liquid to one surface of the liquid transfer target body, and said downstream liquid transfer device transfers the liquid to one of the one surface of the liquid transfer target body which has not been turned over by said convertible device and the other surface of the liquid transfer target body which has been turned over by said convertible device.

9. A liquid transfer apparatus according to claim 1, further comprising rotary phase detection means for detecting a rotary phase of said transport cylinder, wherein said control device disables detection of said contamination-preventive member when said rotary phase detection means detects a phase in which a notch of said transport cylinder opposes said sensor means.

10. A liquid transfer apparatus according to claim 1, further comprising cleaning means for cleaning a detection surface of said sensor means.

11. A liquid transfer apparatus according to claim 1, further comprising alarming means for producing an alarm when said sensor means detects said contamination-preventive member and said drying device is in an inoperative state in response.

12. A liquid transfer apparatus according to claim 1, wherein said sensor means detects a gloss of one of the outer surface of said transport cylinder and said contamination-preventive member, and said control device determines mounting/non-mounting of said contamination-preventive member based on detection by said sensor means.

13. A liquid transfer apparatus according to claim 12, wherein said control device determines that said contamination-preventive member is not mounted when a gloss detected by said sensor means is higher than a reference gloss, and determines that said contamination-preventive member is mounted when the gloss is lower than the reference gloss.

14. A liquid transfer apparatus according to claim 1, wherein said sensor means detects light reflected by one of the outer surface of said transport cylinder and said contamination-preventive member, and the control device determines mounting/non-mounting of said contamination-preventive member based on detection by said sensor means.

15. A liquid transfer apparatus according to claim 14, wherein said control device determines that said contamination-preventive member is not mounted when reflected light detected by said sensor means is larger than reference reflected light, and determines that said contamination-preventive member is mounted when the reflected light detected by said sensor means is smaller than the reference reflected light.

16. A liquid transfer apparatus according to claim 1, wherein said sensor means includes a photoelectric sensor that includes a light-emitting unit and a light-receiving unit which receives light emitted from said light-emitting unit and reflected by one of the outer surface of said transport cylinder and said contamination-preventive member.

17. A liquid transfer apparatus according to claim 1, wherein the detection surface of said sensor means opposes said drying device through said transport cylinder.

18. A liquid transfer apparatus according to claim 1, wherein the detection surface of said sensor means is arranged to oppose said transport cylinder at a position where the detection surface is not affected by light emitted from said drying device.

19. A liquid transfer apparatus according to claim 7, wherein said upstream liquid transfer device comprises a first printing unit which transfers one of ultraviolet ink and oil-based ink to said liquid transfer target body, and a first varnish coating unit which transfers one of ultraviolet varnish, water varnish, and overprint varnish to the liquid transfer target body, and said downstream liquid transfer device comprises a second printing unit which transfers one of ultraviolet ink and oil-based ink to said liquid transfer target body, and a second varnish coating which transfers one of ultraviolet varnish, water varnish, and overprint varnish to the liquid transfer target body.

20. A liquid transfer apparatus according to claim 1, further comprising a selection switch which selects said drying device, wherein when said selection switch is selected and said contamination-preventive member is mounted on the outer surface of said transport cylinder, said control device controls said drying device to perform no drying operation.

21. A liquid transfer apparatus according to claim 8, comprising:

an infrared drying device;

a selection switch which selects said infrared drying device;

a single-sided printing switch; and a double-sided printing switch, wherein when one of said selection switch and said double-sided printing switch is selected and said contamination-preventive member is not mounted on the outer surface of said transport cylinder, said control device controls said drying device to perform no drying operation.

22. A liquid transfer apparatus according to claim 20, further comprising:

a first ultraviolet drying device which is arranged upstream of said first coating unit in a convey direction of the liquid transfer target body;

a first infrared drying device and a second ultraviolet drying device which are arranged between said first coating unit and said convertible device;

a third ultraviolet drying device which is arranged between said second printing unit and said second coating unit; and a second infrared drying device and a fourth ultraviolet drying device which are arranged between said second coating unit and a delivery device.

23. A liquid transfer apparatus according to claim 1, further comprising:

an upstream cylinder which transfers a liquid transfer target body to said transport cylinder; and a downstream cylinder which receives a liquid transfer target body from said transport cylinder, wherein said sensor means is arranged to oppose said transfer cylinder between upstream, in a rotation direction of said transport cylinder, of a transfer position at which said upstream cylinder transfers the liquid transfer target body to said transport cylinder, and downstream, in the rotation direction of said transport cylinder, of a reception position at which said downstream cylinder receives the liquid transfer target body from said transport cylinder.

* * * * *